United States Patent [19]

Koboshi et al.

[11] Patent Number: 4,707,434

[45] Date of Patent: Nov. 17, 1987

[54] COLOR IMAGE FORMING METHOD COMPRISING PROCESSING WITH A BLEACH-FIXING SOLUTION

[75] Inventors: Shigeharu Koboshi; Moeko Higuchi, both of Hino, Japan

[73] Assignee: Konishiroku Photo Industry Co., Ltd., Tokyo, Japan

[21] Appl. No.: 765,592

[22] Filed: Aug. 14, 1985

[30] Foreign Application Priority Data

| | | | |
|---|---|---|---|
| Aug. 20, 1984 | [JP] | Japan | 59-172995 |
| Aug. 20, 1984 | [JP] | Japan | 59-172996 |
| Nov. 5, 1984 | [JP] | Japan | 59-233934 |
| Nov. 15, 1984 | [JP] | Japan | 59-239465 |

[51] Int. Cl.[4] ..... G03C 7/00

[52] U.S. Cl. ..... 430/393; 430/384; 430/385; 430/421; 430/430; 430/460; 430/461; 430/552; 430/553

[58] Field of Search ..... 430/421, 430, 460, 461, 430/393, 384, 385, 552, 553

[56] References Cited

U.S. PATENT DOCUMENTS

| | | | |
|---|---|---|---|
| 3,893,858 | 7/1975 | Wabnitz, Jr. | 430/393 |
| 4,144,068 | 3/1979 | Ishibashi et al. | 430/393 |
| 4,508,816 | 4/1985 | Yamamuru et al. | 430/393 |
| 4,508,817 | 4/1985 | Ohno et al. | 430/393 |
| 4,524,129 | 6/1985 | Kishimoto et al. | 430/393 |
| 4,546,070 | 10/1985 | Kishimoto et al. | 430/393 |
| 4,554,242 | 11/1985 | Ohno et al. | 430/393 |

FOREIGN PATENT DOCUMENTS

| | | |
|---|---|---|
| 0084637 | 3/1983 | European Pat. Off. . |
| 2112706 | 7/1983 | United Kingdom . |

*Primary Examiner*—John E. Kittle
*Assistant Examiner*—Mukund J. Shah
*Attorney, Agent, or Firm*—Frishauf, Holtz, Goodman & Woodward

[57] ABSTRACT

Disclosed is a color forming method which comprises subjecting a light-sensitive silver halide color photographic material having a photographic constituent layer comprising blue-sensitive, green-sensitive and red-sensitive silver halide emulsion layers on a support and having a total thickness of the photographic constituent layer of 25 μm or less to imagewise exposure, then carrying out color developing processing of the exposed material in the presence of a dye forming coupler and processing the developed image with a bleach-fixing solution.

The color forming method of the present invention enables rapid processing of a high sensitivity color light-sensitive material.

13 Claims, 1 Drawing Figure

COLOR IMAGE FORMING METHOD COMPRISING PROCESSING WITH A BLEACH-FIXING SOLUTION

BACKGROUND OF THE INVENTION

This invention relates to a color image forming method. More particularly, it pertains to a color image forming method having a rapid silver bleach-fixing ability.

Generally speaking, for obtaining a color image by processing of a light-sensitive silver halide color photographic material subjected to imagewise exposure, there is provided the step of processing the metal silver formed with a processing solution having bleaching ability after the step of color developing step.

As the processing solution having bleaching ability, there have been known bleaching solutions and bleach-fixing solutions. When a bleaching solution is employed, the step of fixing silver halide with a fixing agent is usually added subsequent to the bleaching step, but in some cases the bleach-fixing processing performing bleaching and fixing in one step may be practiced.

In the processing solution having bleaching ability in processing of color light-sensitive materials, inorganic oxidizing agents such as red prussiate, dichromate, etc. have been widely used as the oxidizing agent.

However, the processing solution having bleaching ability containing these inorganic oxidizing agents has been pointed out to involve some serious drawbacks. For example, red prussiate and dichromate are relatively excellent in bleaching power of the image silver, but they have properties undesirable in prevention of pollution, because there is the fear that cyan ions or hexavalent chromium ions harmful to human bodies may be formed by decomposition with light. Also, these oxidizing agents have very potent oxidizing power and they can hardly be permitted to co-exist with a silver halide solubilizing agent (fixing agent) such as thiosulfate, etc. in the same processing solution, and it is almost impossible to use these oxidizing agents in the bleach-fixing solution, thus making it difficult to accomplish the object of rapid and simple processing. Further, the processing solution containing these inorganic oxidizing agents has the drawback that it is difficult to regenerate it for reuse without discarding the waste solution after processing.

In contrast, as a processing solution causing little problem of pollution and suited for the requirement of more rapid and simplified processing as well as possiblity of regenerated use of the waste solution, a processing solution utilizing a metal complex of an organic acid such as aminopolycarboxylic acid metal complex, etc. is coming into use. However, the processing solution employing a metal complex of organic acid, due to its weak oxidative power, has the drawback of slow bleaching speed (oxidation speed) of the image silver (metal silver) formed in the developing step. For example, iron (III) ethylenediaminetetraacetate complex, considered to have a potent bleaching power among aminopolycarboxylic metal complexes, has been practically applied as the bleaching solution and the bleach-fixing solution in some uses, but in high sensitivity color light-sensitive materials comprising mainly silver bromide, silver iodobromide emulsion, particularly color negative film, color reversal film for photography containing silver iodide as the silver halide, it is insufficient in bleaching power and traces of image silver will remain even after prolonged processing, resulting in bad desilverization. This tendency will be more marked in a bleach-fixing solution where thiosulfate and sulfite co-exist, because the redox potential is lowered. Particularly, it has been found that the desilverization characteristic is markedly bad in a high sensitivity color light-sensitive material containing silver iodide for photography containing black colloid silver for halation prevention.

Further, as a silver halide emulsion, which is a high sensitivity emulsion containing silver iodide, micropulverized and suited for the requirement of resource protection with effective utilization of silver, there is the core-shell emulsion has been recently developed. The core-shell emulsion is a mono-dispersed core-shell emulsion which is prepared by utilizing the preceding silver halide emulsion as the crystal nuclei, then laminating successively the subsequent precipitate, while controlling intentionally the composition or the environment with lapse of time for respective precipitates. Among them, the aforesaid core-shell type high sensitivity emulsion containing silver iodide in the core and/or the shell has an extremely preferable specific feature in photographic performance, but when applied in a conventional bleach-fixing bath for a color light-sensitive material, it proved to be very poor in bleach-fixing characteristic of developed silver and silver halide.

For example, the developed silver in the silver halide emulsion for photography containing 0.5 mole % or more of silver iodide, particularly the developed silver of the silver halide containing 0.5 mole % or more of silver iodide in the core and/or the shell in the core-shell type emulsion, although being excellent in sensitivity, graininess, covering power, etc., is markedly bad in bleaching characteristic in the color light-sensitive material in which the developed silver must be bleached, due to the form of the developed silver which is different from that of the prior art.

Alternatively, attempts have also been made of utilizing flat plate silver halide grains as disclosed in Japanese Provisional Patent Publications No. 113930/1983, No. 113934/1983, No. 127921/1983 and No. 108532/1983. Even if the photoquantum number captured by silver halide grains may be increased by use of the flat plate silver halide grains, the amount of silver employed is not increased and there occurs no worsening to image quality, as discussed in these specifications. However, even with the use of such flat plate silver halide grains, the developed silver formed by development with a p-phenylenediamine type color developing agent has the drawback of poor silver bleaching characteristic. Accordingly, it has particularly strongly been desired to have a processing solution which is capable of bleach-fixing rapidly a color light-sensitive material comprising a core-shell emulsion and/or flat plate silver halide emulsion containing silver iodide having excellent features as described above and also having a halation preventive layer comprising black colloid silver.

SUMMARY OF THE INVENTION

The first technical task of the present invention is to provide a method for bleach-fixing processing of a color light-sensitive material containing high sensitivity silver iodide of the high sensitivity microparticulate type which can satisfy both resource protection and ultra-high sensitivity, and the second technical task is to provide a color image forming method with a bleach-fixing solution which enables rapid processing of a high sensitivity color light-sensitive material.

Thus, the present invention provides a color image forming method, which comprises subjecting a light-sensitive silver halide color photographic material having a photographic constituent layer comprising blue-sensitive, green-sensitive and red-sensitive silver halide emulsion layers on a support and having a total thickness of the photographic constituent layer of 25 μm or less to imagewise exposure, then carrying out color developing processing of the exposed material in the presence of a dye forming coupler and processing the developed image with a bleach-fixing solution.

DESCRIPTION OF THE PREFERRED EMBODIMENT

Figure 1:
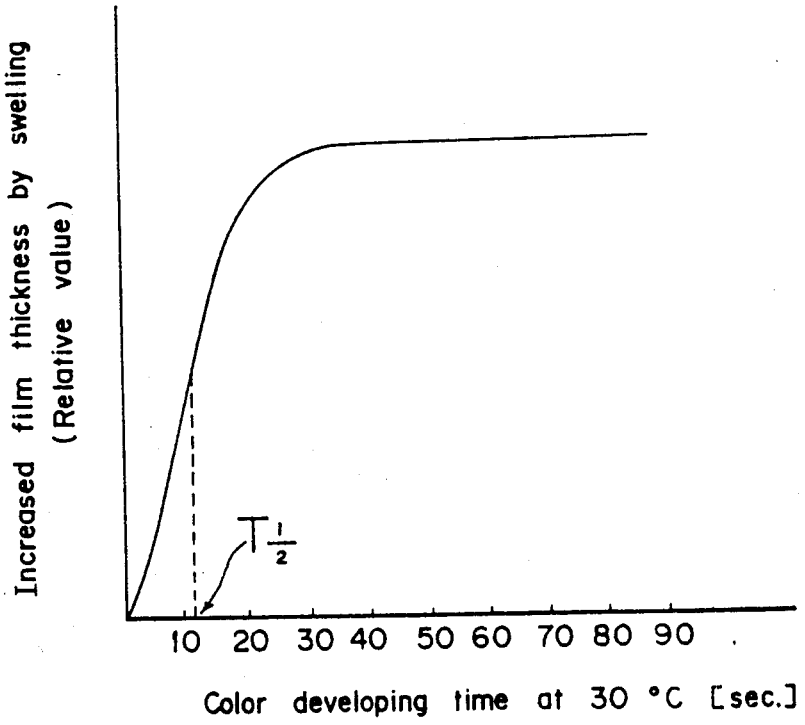
FIG. 1 is a graph showing a film swelling speed $T_{\frac{1}{2}}$ of a binder.

Here, the photographic constituent layer refers to all the hydrophilic colloid layers existing on the same side as the support side on which at least three silver halide emulsion layers of blue-sensitive, green-sensitive and red-sensitive emulsion layers are provided. It is particularly effective, when there is provided black colloid silver halation preventive layer, and otherwise also include, in addition to silver halide emulsion layers, for example, subbing layer, intermediate layers (mere intermediate layer, filter layer, UV-ray absorbing layer, etc.), protective layer, etc.

According to a preferred embodiment, the bleach-fixing solution contains at least one organic acid ferric complex, selected preferably from the compounds of the formulae [I]-[VII] shown below:

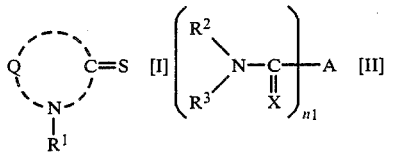

[I]

[II]

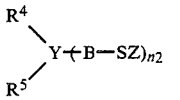

[III]

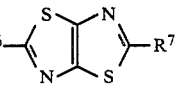

[IV]

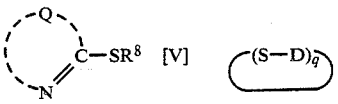

[V] [VI]

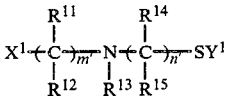

[VII]

In the above formulae, Q represents a group of atoms necessary for forming a hetero ring containing 1 or more N atom (including those having at least one 5- to 6-membered unsaturated ring fused thereto); A represents a group of the formulae:

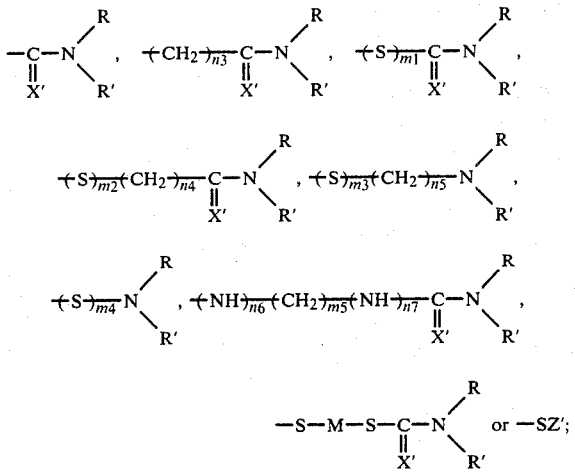

or a hetero ring residue with $n_1$ valence (including those having at least one 5- to 6-membered unsaturated ring fused thereto); B represents an alkylene group having 1 to 6 carbon atoms; M represents a divalent metal atom; X and X' represent =S, =O or =NR''; R'' represents a hydrogen atom, an alkyl group having 1 to 6 carbon atoms, a cycloalkyl group, an aryl group, a hetero ring residue (including those having at least one 5- to 6-membered unsaturated ring fused thereto) or an amino group; Y represents

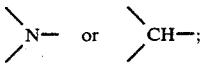

Z represents a hydrogen atom, an alkali metal atom, an ammonium group, an amino group, a nitrogen containing hetero ring residue or

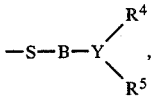

Z' represents Z or an alkyl group; $R^1$ represents a hydrogen atom, an alkyl group having 1 to 6 carbon atoms, a cycloalkyl group, an aryl group, a hetero ring residue (including those having at least one 5- to 6-membered unsaturated ring fused thereto) or an amino group; each of $R^2$, $R^3$, $R^4$, $R^5$, R and R' represents a hydrogen atom, an alkyl group having 1 to 6 carbon atoms, a hydroxy group, a carboxy group, an amino group, an acyl group having 1 to 3 carbon atoms, an aryl group, or an alkenyl group, with proviso that $R^4$ and $R^5$ may represent —B—SZ, and R and R', $R^2$ and $R^3$, $R^4$ and $R^5$, respectively, may be mutually cyclized to form a hetero ring residue (including those having at least one 5- to 6-membered unsaturated ring fused thereto); $R^6$ and $R^7$ each represent a group of the formula:

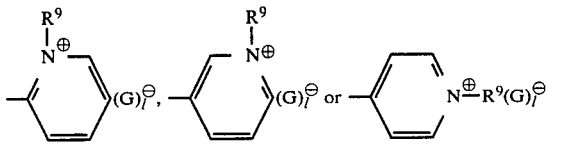

$R^9$ represents an alkyl group or $-(CH_2)_{n8}SO_3^{\ominus}$ (when $R^8$ is $-(CH_2)_{n8}SO_3^{\ominus}$, 1 represetns 0 or 1); $G^{\ominus}$ is an anion; $m_1$ to $m_4$ and $n_1$ to $n_8$ each represent integers of 1 to 6; $m_5$ represents an integer of 0 to 6; $R^8$ represents a hydrogen atom, an alkali metal atom, a group of the formula:

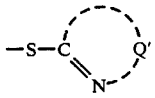

or an alkyl group; Q' is the same as the above Q; D is a mere bonding linkage, an alkylene group having 1 to 8 carbon atoms or a vinylene group; q represents an integer of 1 to 10; the plural number of D may be either the same or different; the ring formed together with sulfur atoms may be fused further to a 5- to 6-membered unsaturated ring; $X^1$ represents —COOM', —OH, $—SO_3M'$, $—CONH_2$, $—SO_2NH_2$, $—NH_2$, —SH, —CN, $—CO_2R^{16}$, $—SO_2R^{16}$, $—OR^{16}$, $—NR^{16}R^{17}$, $—SR^{16}$, $—SO_3R^{16}$, $—NHCOR^{16}$, $—NHSO_2R^{16}$, $—COR^{16}$ or $—OSO_2R^{16}$; $Y^1$ represents a group of the formula:

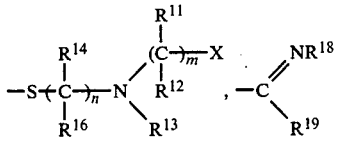

or a hydrogen atom; m' and n' each represent an integer of 1 to 10; $R^{11}$, $R^{12}$, $R^{14}$, $R^{15}$, $R^{17}$ and $R^{18}$ each represent a hydrogen atom or a lower alkyl group; $R^{13}$ represents a hydrogen atom, a lower alkyl group or a group of the formula: group of the formula:

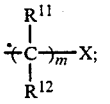

$R^{16}$ represents a lower alkyl group; $R^{19}$ represents $—NR^{20}R^{21}$, $—OR^{22}$ or $SR^{22}$; $R^{20}$ and $R^{21}$ each represent a hydrogen atom or a lower alkyl group; $R^{22}$ represents a group of atoms necessary for formation of a ring by linking to $R^{18}$; $R^{20}$ or $R^{21}$ may be linked to $R^{18}$ to form a ring; M' represents a hydrogen atom or a cation; said compounds of the formula [I]–[V] including enol derivatives and salts thereof.

Thus, the present inventors have studied intensively with particular interest the phenomenon that a light-sensitive high sensitivity microparticulate silver halide color photographic material of at least three layers having black colloid silver as the halation preventive layer and containing at least 0.5 mole % of silver iodide is markedly poor in bleach-fixing characteristic, and consequently found that desilverization can sufficiently be effected even with a bleach-fixing solution containing an organic acid ferric complex, provided that the total amount of silver coated in the color light-sensitive material and the emulsion layer thickness are within certain values and the film swelling speed $T_{\frac{1}{2}}$ of the binder is 25 seconds or less. Further, when it is processed with a bleach-fixing solution in which specific compounds according to the present invention are combined, the bleach-fixing completion time of the color light-sensitive material containing silver iodide to be processed was found to be further shortened. Particularly, when the photographic constituent layer in the silver halide emulsion of the photographic material becomes thinner than a certain value according to the present invention, the bleach-fixing characteristic was found to be markedly improved to improve bad desilverization.

Further, surprisingly, the present inventors have found the fact that, as the molecular weight of the organic acid of the organic acid ferric complex becomes greater, the bleaching accelerating action is increased due to smaller binder film swelling speed of the photographic constituent layer (gelatin film), whereby the bleaching time can be markedly shortened. On the other hand, it has also been found that, as the molecular weight of the organic acid of the organic ferric complex becomes smaller, the bleaching accelerating action due to reduction in thickness of the photographic constituent layer (gelatin film) increases, whereby bleach-fixing time is similarly markedly shortened.

More specifically, as the molecular weight of the organic ferric complex becomes greater, the oxidative power of silver is generally increased, but the action of hardening the film constituting the photographic constituent layer also increases, whereby diffusion penetration of the bleach-fixing components is markedly lowered to cause interference with bleach-fixing, which becomes greater in proportion to the thickness of the photographic constituent layer. However, no such interference occurs, when the gelatin film has the characteristic of very poor film swelling speed. In contrast, an organic acid ferric complex with smaller molecular weight may be weakened somewhat in oxidative power of silver, but interference with bleach-fixing is also small. Hence, it has been found that, provided that the photographic constituent layer is thinner than a certain value according to the present invention, or the gelatin film swelling speed is large similarly as above, substantially sufficient bleaching power can be obtained.

Further, interference with bleach-fixing intensified due to marked bad desilverization occurs at the boundary portion between the black colloid silver containing halation preventive layer and the silver iodide containing silver halide emulsion layer, when the film thickness of the photographic constituent layer of the color light-sensitive layer containing silver iodide becomes greater, is also found to be alleviated by making the thickness of the photographic constituent layer a certain value or lower according to the present invention and accelerating the gelatin film swelling speed to a certain level or higher.

Thus, according to the present invention, an epoch-making bleach-fixing method has been found, in which the bleach-fixing characteristic is not impaired by use of an organic acid ferric complex with any molecular weight.

According to a preferred embodiment of the present invention, the photographic constituent layer of the color light-sensitive layer has a film thickness of 22 μm or less, particularly preferably 20 μm or less, the film swelling speed of binder $T_{\frac{1}{2}}$ is 20 seconds or less, particularly preferably 15 seconds or less, most preferably 10 seconds or less, and the aforesaid bleach-fixing accelerator and the organic acid forming the organic ferric complex are those as mentioned below. The objects of the present invention were found to be accomplished more effectively by satisfying these requirements.

(1)

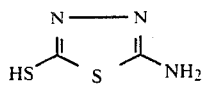

(2)

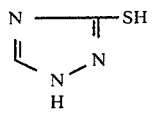

(3)

$$H_2N-\underset{\underset{S}{\|}}{C}-NHNH-\underset{\underset{S}{\|}}{C}-NH_2$$

(4)

$$HO-CH_2-\underset{\underset{OH}{|}}{CH}-CH_2SH$$

(5)

$$HS-CH_2CH_2-COOH$$

(6)

$$(C_2H_5)_2N-CH_2CH_2-SH$$

(7)

$$(H_3C)_2N-CH_2CH_2-SH$$

(8)

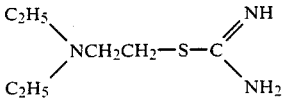

(9)

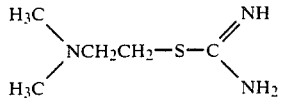

(10)

$$(C_2H_5)_2N-CH_2CH_2-S-S-CH_2CH_2N(C_2H_5)_2$$

(11)

$$(CH_3)_2N-CH_2CH_2-S-S-CH_2CH_2N(CH_3)_2$$

(12)

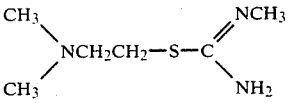

(13)

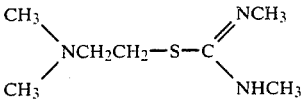

(14)

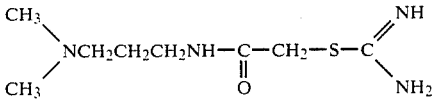

-continued (15)

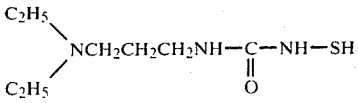

(16)

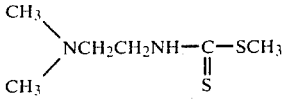

(17)

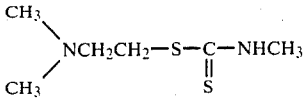

(18)

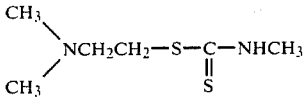

(19)

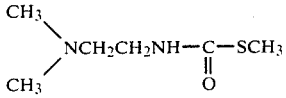

(20)

(21)

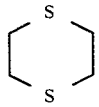

(22)

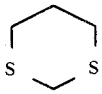

(23)

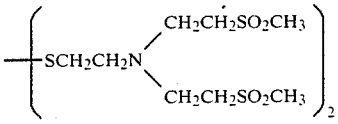

(24)

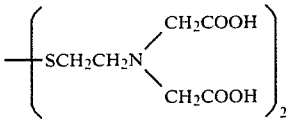

(25)

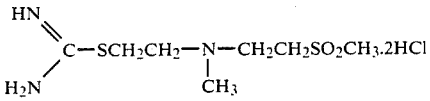

(26)

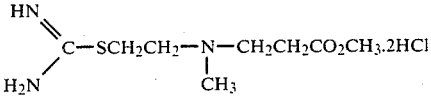

(27)

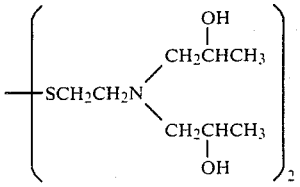

-continued $HSCH_2CH_2NHCH_2CH_2OH$ (28)

$HSCH_2CH_2-N(C_2H_5)-CH_2CH_2OH$ (29)

$HSCH_2CH_2N(CH_2CH_2SO_2CH_3)_2 \cdot \frac{1}{2}H_2SO_4$ (30)

| | |
|---|---|
| Diethylenetriaminetetraacetic acid | (31) |
| Cyclohexanediaminotetraacetic acid | (32) |
| Triethylenetetraminehexaacetic acid | (33) |
| Glycoletherdiaminetetraacetic acid | (34) |
| 1,2-Diaminopropanetetraacetic acid | (35) |
| 1,3-Diaminopropane-2-ol tetraacetic acid | (36) |
| Ethylenediaminedi-o-hydroxyphenylacetic acid | (37) |
| Ethylenediaminetetraacetic acid | (38) |
| Nitrilotriacetic acid | (39) |
| Iminodiacetic acid | (40) |
| Methyliminodiacetic acid | (41) |
| Hydroxyethyliminodiacetic acid | (42) |
| Ethylenediaminetetrapropionic acid | (43) |
| Dihydroxyethylglycine | (44) |
| Nitrilotripropionic acid | (45) |
| Ethylenediaminediacetic acid | (46) |
| Ethylenediaminedipropionic acid | (47) |

Further, as the most effective embodiment, it has been found possible to accomplish the above objects of the present invention according to the processing method, in which a fixing processing is applied as the pre-processing step before the bleach-fixing processing after the color developing processing. In the following, this fixing processing is called pre-fixing processing or pre-fixing, and the processing solution to be used for said pre-fixing processing is called pre-fixing solution or pre-fixing processing bath or pre-fixing bath.

In the following, the present invention will be explained in more detail.

For the hydrophilic binder to be used for coating of silver halide in the light-sensitive silver halide color photographic material, gelatin is usually employed, but a polymer may sometimes be employed, and the film swelling speed $T_{\frac{1}{2}}$ is required to be 25 seconds or shorter. The film swelling speed $T_{\frac{1}{2}}$ can be measured according to any method known in this field of the art. For example, it can be measured by use of a Swellometer of the type as disclosed in A. Green et al, Photographic Science and Engineering, Vol. 19, No. 2, pp. 124–129. $T_{\frac{1}{2}}$ is defined as the time before reaching $\frac{1}{2}$ of the saturated film thickness which is 90% of the maximum swelled film thickness, when processed in a color developing solution at 30° C. for 3 minutes and 15 seconds. (see FIG. 1).

The film swelling speed $T_{\frac{1}{2}}$ can be controlled by addition of a film hardening agent to gelatin as the binder.

Film hardening agents may include an aldehyde series, an azilidine series (e.g., as disclosed in PB report No. 19,921, U.S. Pat. Nos. 2,950,197, 2,964,404, 2,983,611 and 3,271,175, Japanese Patent Publication No. 40898/1971, Japanese Provisional Patent Publication No. 91315/1975, etc.), an oxazole series (e.g., as disclosed in U.S. Pat. No. 331,609), an epoxy series (e.g., as disclosed in U.S. Pat. No. 3,047,394, West German Pat. No. 1,085,663, Great Britain Pat. No. 1,033,518, Japanese Patent Publication No. 35495/1973, etc.), a vinyl sulfone series (e.g., as disclosed in PB report No. 19,920, West German Pat. No. 1,00,942, No. 2,337,412, No. 2,545,722, No. 2,635,518, No. 2,742,308 and No. 2,749,260, Great Britain Pat. No. 1,251,091, U.S. Pat. Nos. 3,539,644 and 3,490,911, etc.), an acryloyl series (e.g., U.S. Pat. No. 3,640,720, etc.), a carbodiimide series (e.g., U.S. Pat. Nos. 2,938,892, 4,043,818 and 4,061,499, Japanese Patent Publication No. 38715/1971, etc.), a triazine series (e.g., West German Patent Publications No. 2,410,973 and No. 2,553,915, U.S. Pat. No. 3,325,287, Japanese Provisional Patent Publication No. 12722/1977, etc.), a polymer type (e.g., Great Britain Pat. No. 822,061, U.S. Pat. Nos. 3,623,878, 3,396,029 and 3,226,234, Japanese Patent Publications No. 18578/1972, No. 18579/1972 and No. 48896/1972, etc.), and others such as a maleimide series, an acetylene series, a methane sulfonic acid ester series (N-methylol series) may be mentioned, which may be used alone or in combination with two or more of the above. Preferable combinations may be mentioned as disclosed in West German Patent Publications No. 2,447,587, No. 2,505,746 and No. 2,514,245, U.S. Pat. Nos. 4,047,957, 3,832,181 and 3,840,370, Japanse Patent Publications No. 43319/1973, 63062/1975 and 127329/1977 and Japanese Patent Publication No. 32364/1973.

The binder in the photographic constituent layer to be used in the color photographic material of the present invention should have a film swelling speed $T_{\frac{1}{2}}$ of 25 seconds or less, which should preferably as small as possible. Its lower limit should be 1 second or more, since troubles such as formation of scratches may be caused, if it is too small. More preferably, it should be 2 seconds to 20 seconds, particularly preferably 15 seconds or less, most preferably 10 seconds or less. If it is greater than 25 seconds, desiliverization, namely the bleach-fixing performance will be deteriorated. Particularly, such deterioration will noticeably occur when a low molecular weight organic acid ferric complex is used, or even when a high molecular weight organic acid ferric complex may be used at a higher concentration.

The bleaching accelerator of the present invention is represented by the above formulae [I] to [VII], and typical examples thereof are enumerated below, but the present invention is not limited thereto.

[Exemplary compounds]

(I-1)

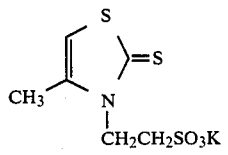

(I-2)

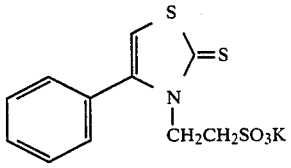

-continued
[Exemplary compounds]
(I-3)
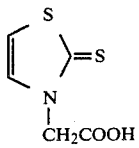
(I-4)
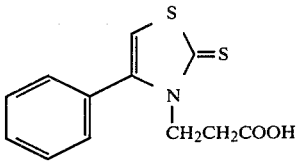
(I-5)
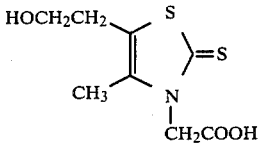
(I-6)
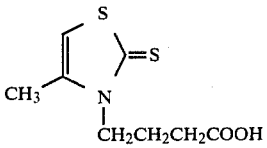
(I-7)
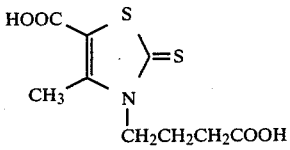
(I-8)
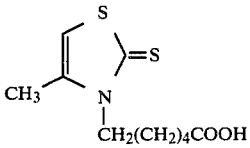
(I-9)
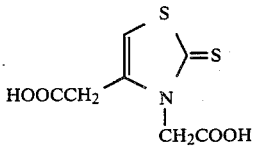
(I-10)
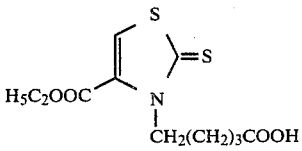
(I-11)
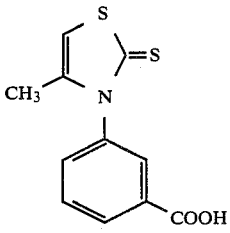
(I-12)
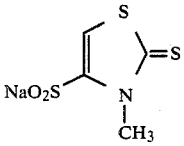
(I-13)
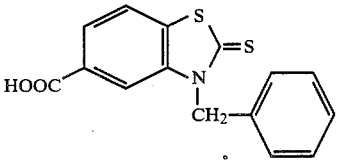
(I-14)
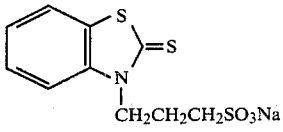
(I-15)
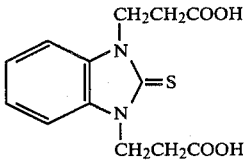
(I-16)
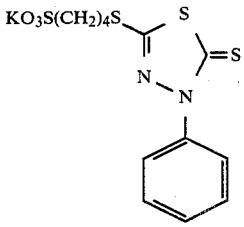
(I-17)
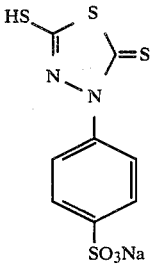
(I-18)
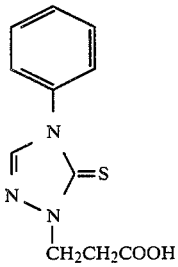

-continued
[Exemplary compounds]
(I-19)
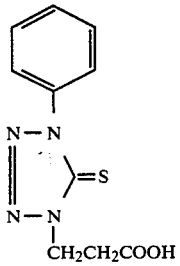
(I-20)
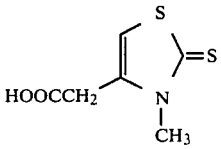
(I-21)
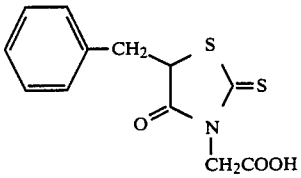
(I-22)
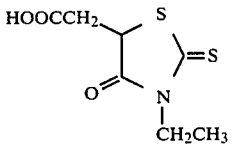
(I-23)
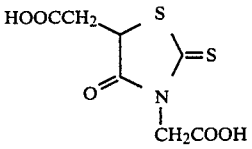
(I-24)
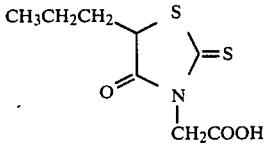
(I-25)
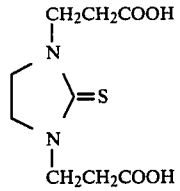
(I-26)
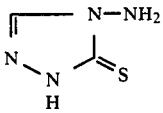
(I-27)
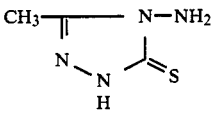
(I-28)
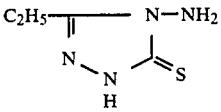
(I-29)
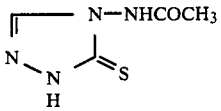
(I-30)
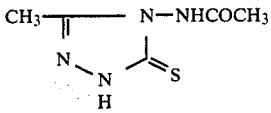
(I-31)
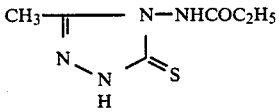
(I-32)
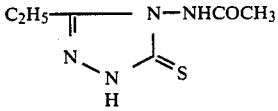
(I-33)
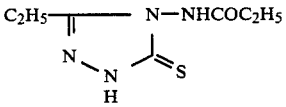
(I-34)
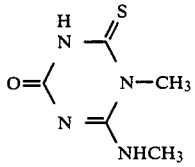
(I-35)
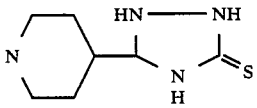
(I-36)
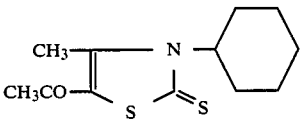
(I-37)
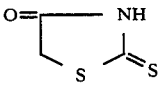
(I-38)
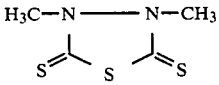

-continued
[Exemplary compounds]
(II-1)
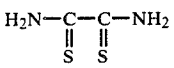
(II-2)
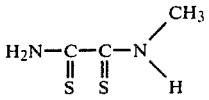
(II-3)
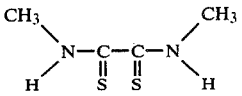
(II-4)
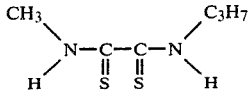
(II-5)
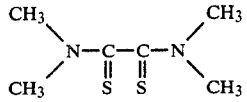
(II-6)
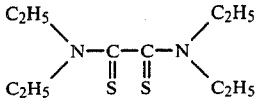
(II-7)
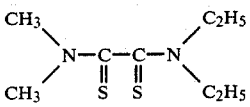
(II-8)
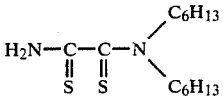
(II-9)
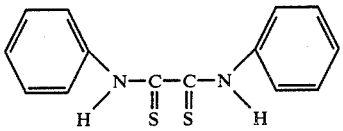
(II-10)
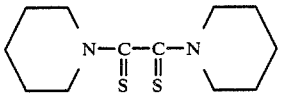
(II-11)
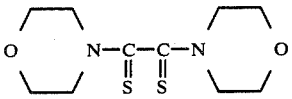
(II-12)
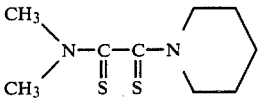
(II-13)
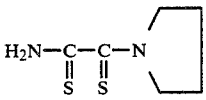
(II-14)
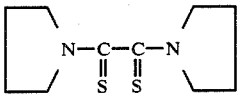
(II-15)
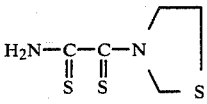
(II-16)
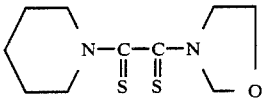
(II-17)
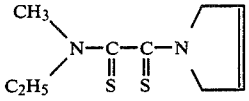
(II-18)
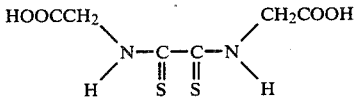
(II-19)
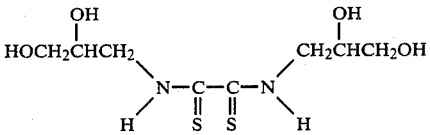
(II-20)
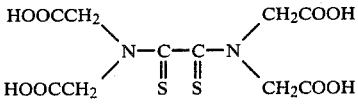
(II-21)
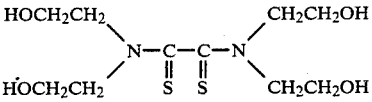
(II-22)
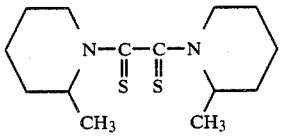
(II-23)
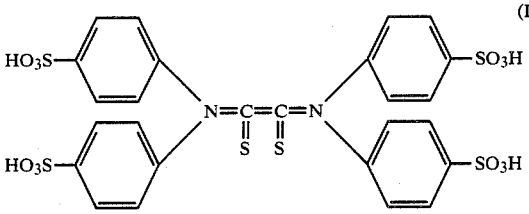
(II-24)
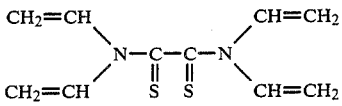

-continued
[Exemplary compounds]
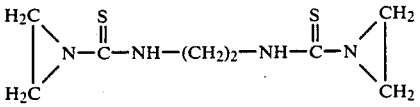
(II-25)
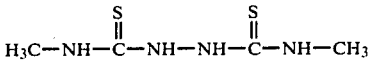
(II-26)
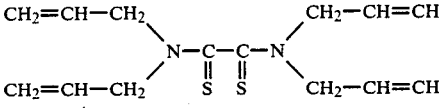
(II-27)
$H_2N-CSNHNHCS-NH_2$
(II-28)
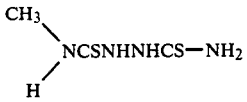
(II-29)
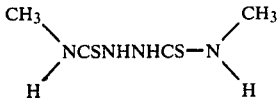
(II-30)
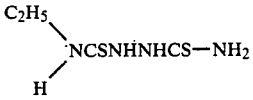
(II-31)
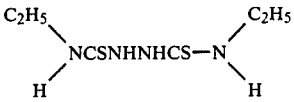
(II-32)
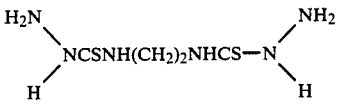
(II-33)
$H_2N-CSNH(CH_2)_2NHCS-NH_2$
(II-34)
$H_2N-CSNH(CH_2)_4NHCS-NH_2$
(II-35)
$H_2N-CSNH(CH_2)_5NHCS-NH_2$
(II-36)
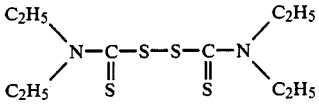
(II-37)
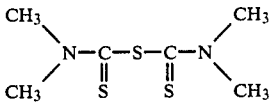
(II-38)
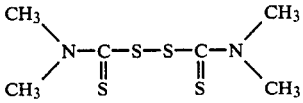
(II-39)
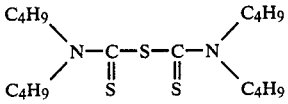
(II-40)
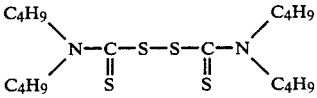
(II-41)
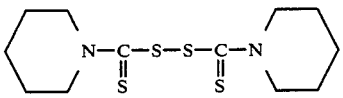
(II-42)
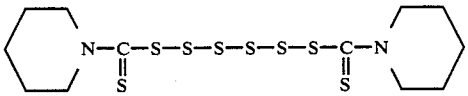
(II-43)
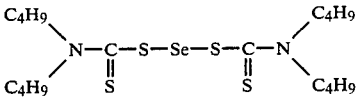
(II-44)
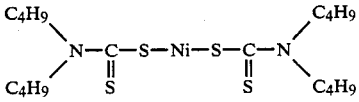
(II-45)
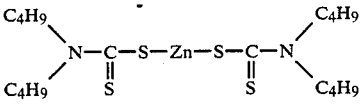
(II-46)
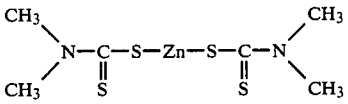
(II-47)
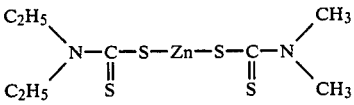
(II-48)
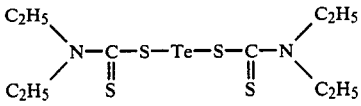
(II-49)
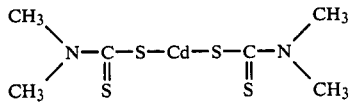
(II-50)
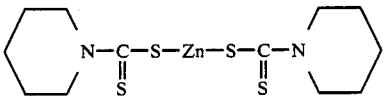
(II-51)
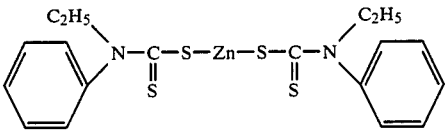
(II-52)

-continued
[Exemplary compounds]
(II-53)
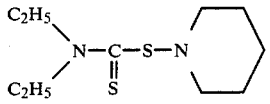
(II-54)
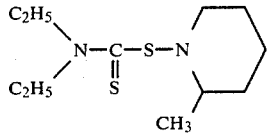
(II-55)
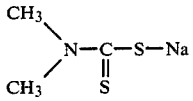
(II-56)
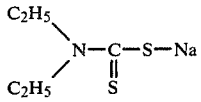
(II-57)
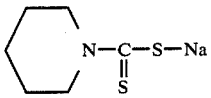
(II-58)
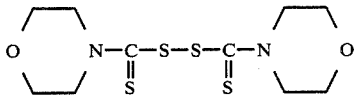
(II-59)
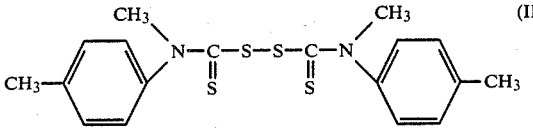
(II-60)
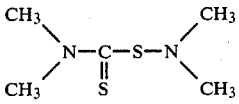
(II-61)
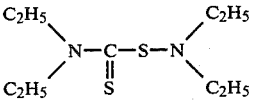
(II-62)
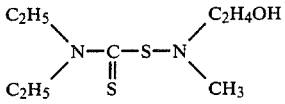
(II-63)
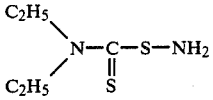
(II-64)
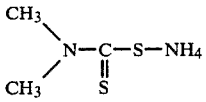
(II-65)
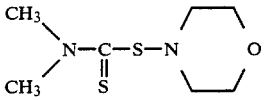
(II-66)
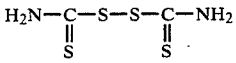
(II-67)
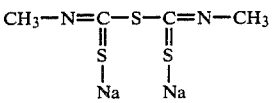
(II-68)
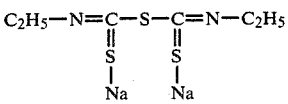
(II-69)
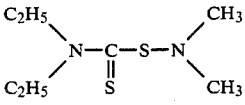
(II-70)
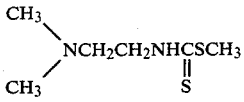
(II-71)
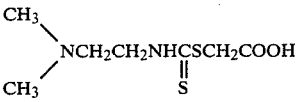
(II-72)
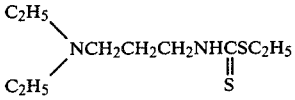
(II-73)
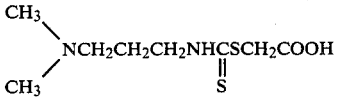
(II-74)
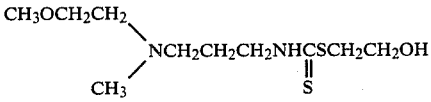
(II-75)
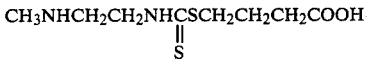
(II-76)
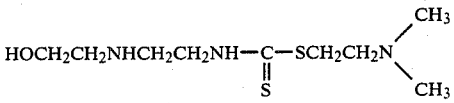
(II-77)
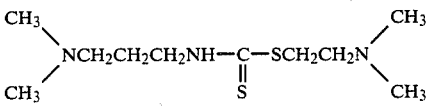
(II-78)
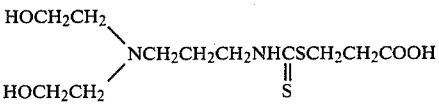

-continued
[Exemplary compounds]
(II-79)
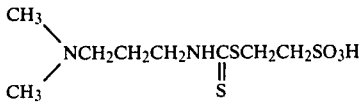
(II-80)
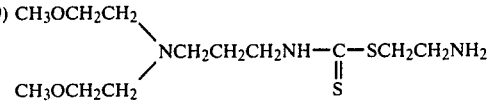
(II-81)
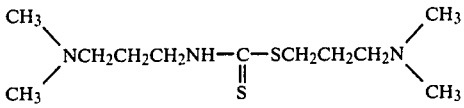
(II-82)
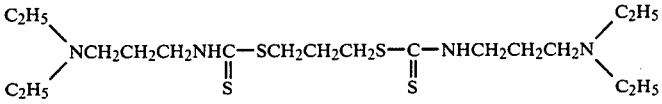
(II-83)
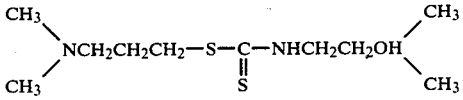
(II-84)
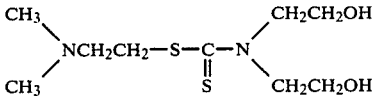
(II-85)
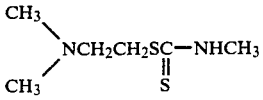
(II-86)
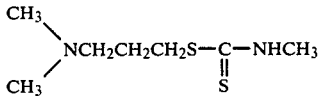
(II-87)
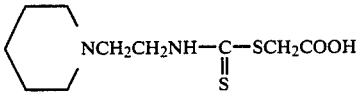
(II-88)
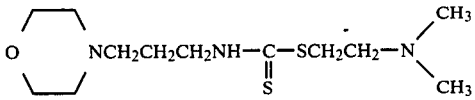
(II-89)
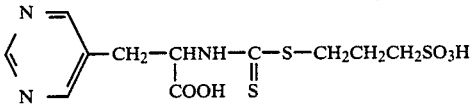
(II-90)
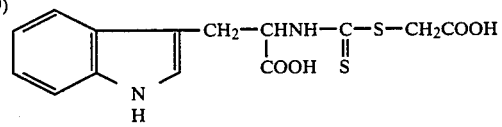
(II-91)
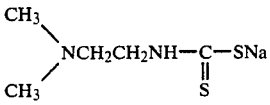
(II-92)
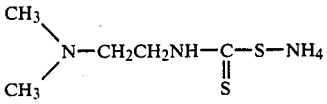
(II-93)
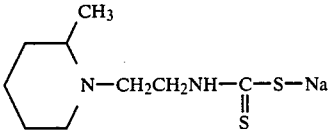
(II-94)
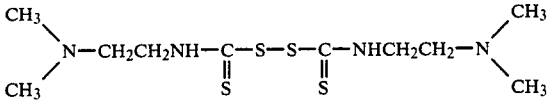
(II-95)
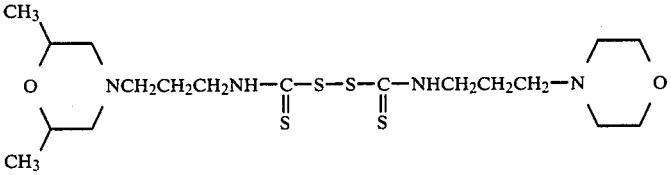
(II-96)
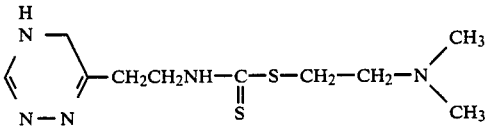
(II-97)
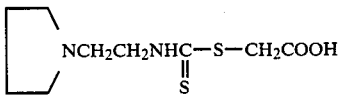
(II-98)
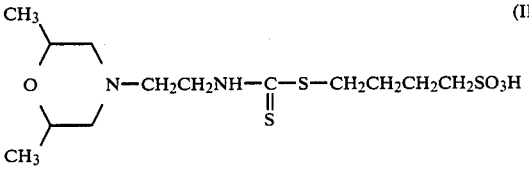
(II-99)
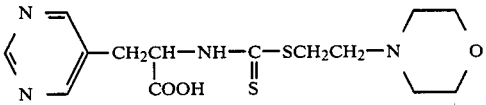

-continued
[Exemplary compounds]
(II-100)
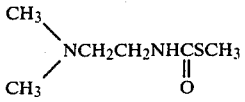
(II-101)
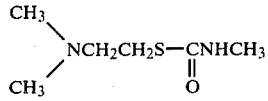
(II-102)
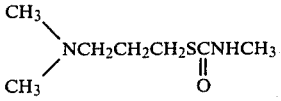
(II-103)
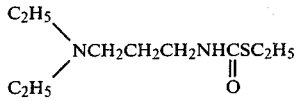
(II-104)
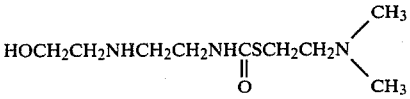
(II-105)
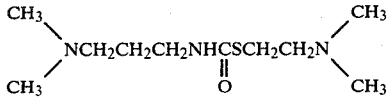
(II-106)
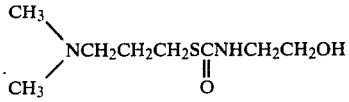
(II-107)
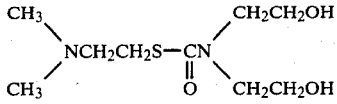
(II-108)
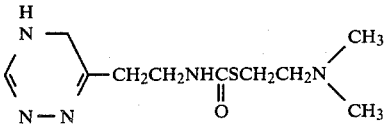
(II-109)
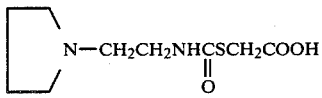
(II-110)
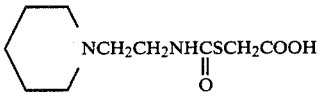
(II-111)
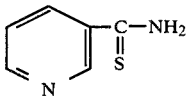
(II-112)
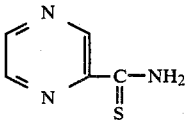
(II-113)
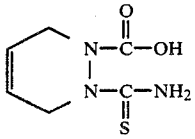
(II-114)
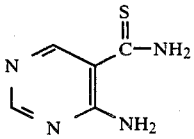
(II-115)
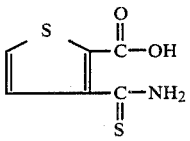
(II-116)
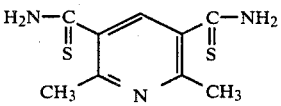
(II-117)
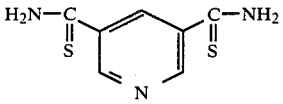
(II-118)
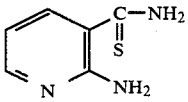
(II-119)
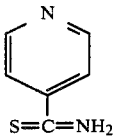
(II-120)
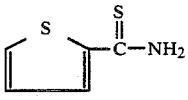
(II-121)
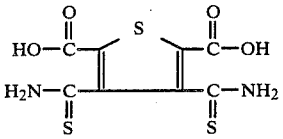
(II-122)
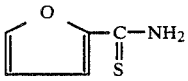
(II-123)
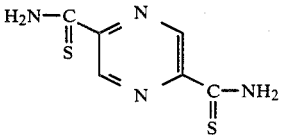

-continued
[Exemplary compounds]
(II-124)
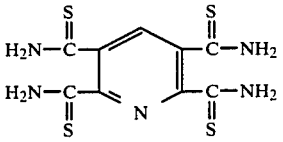
(II-125)
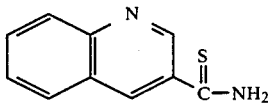
(II-126)
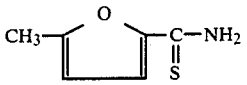
(II-127)
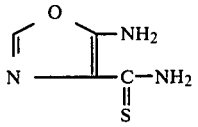
(II-128)
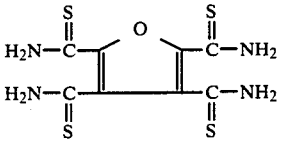
(II-129)
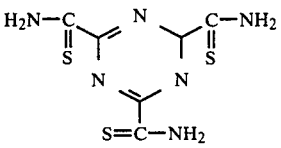
(II-130)
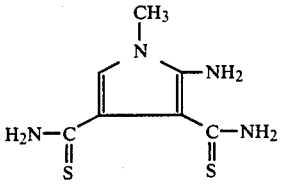
(II-131)
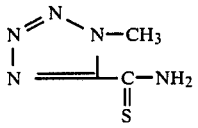
(II-132)
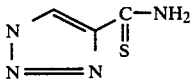
(II-133)
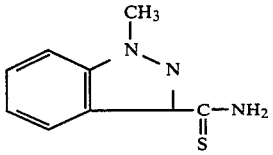
(II-134)
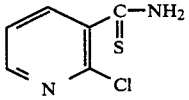
(II-135)
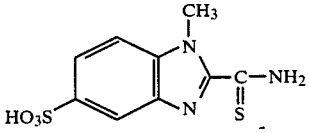
(II-136)
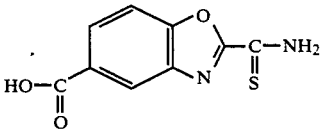
(II-137)
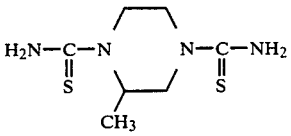
(II-138)
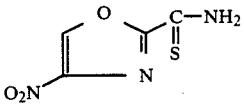
(II-139)
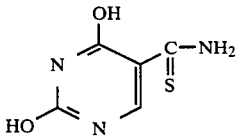
(II-140)
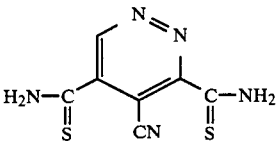
(II-141)
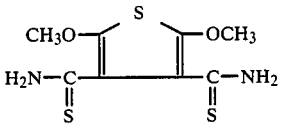
(II-142)
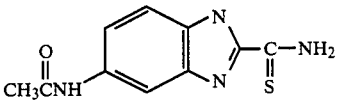
(II-143)
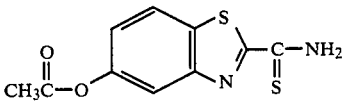
(II-144)
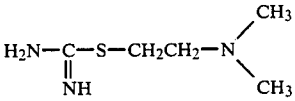
(II-145)
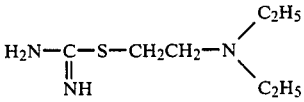

-continued
[Exemplary compounds]
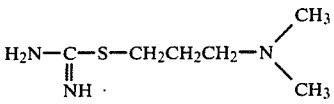
(II-146)
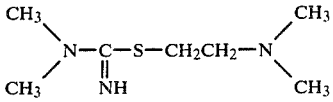
(II-147)
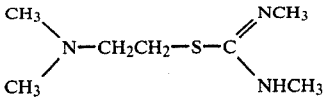
(II-148)
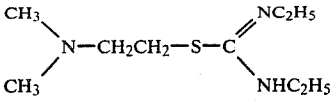
(II-149)
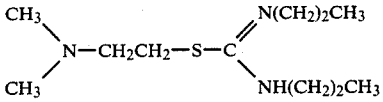
(II-150)
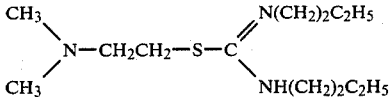
(II-151)
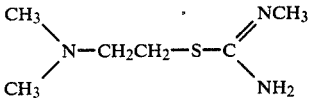
(II-152)
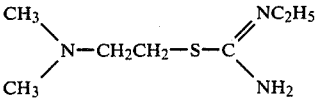
(II-153)
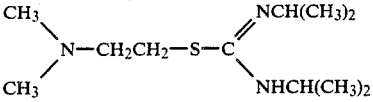
(II-154)
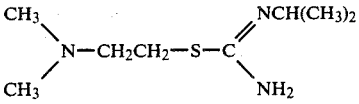
(II-155)
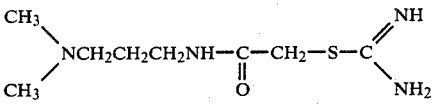
(II-156)
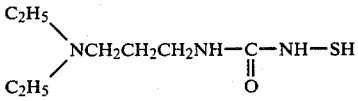
(II-157)
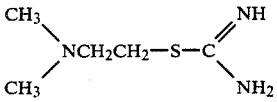
(II-158)
$H_2N-CH_2CH_2-SH$ (III-1)
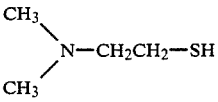
(III-2)
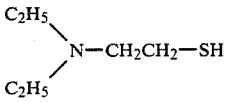
(III-3)
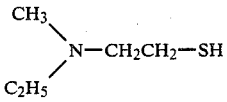
(III-4)
HOOC.$CH_2CH_2$.SH (III-5)
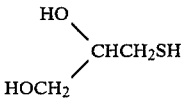
(III-6)
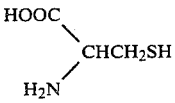
(III-7)
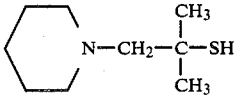
(III-8)
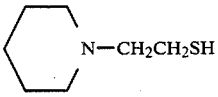
(III-9)
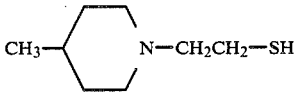
(III-10)
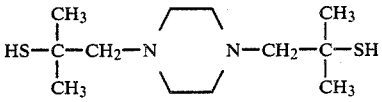
(III-11)
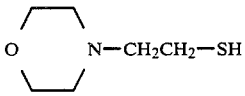
(III-12)
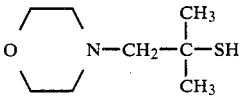
(III-13)

-continued
[Exemplary compounds]
(III-14)
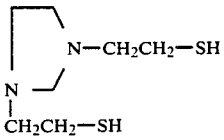
(III-15)
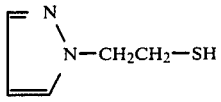
(III-16)
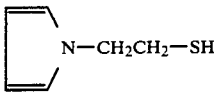
(III-17)
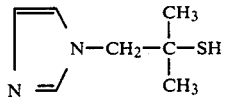
(III-18)
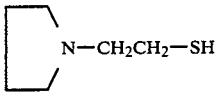
(III-19)
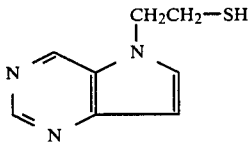
(III-20)
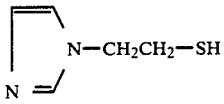
(III-21)
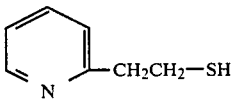
(III-22)
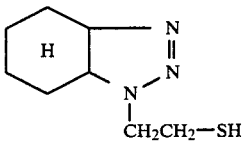
(III-23)
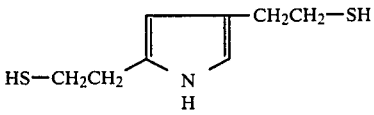
(III-24)
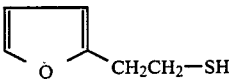
(III-25)
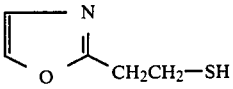
(III-26)
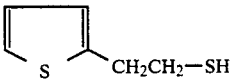
(III-27)
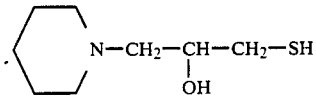
(III-28)
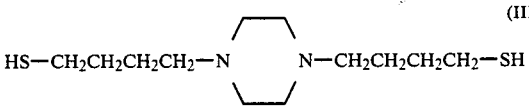
(III-29)
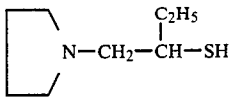
(III-30)
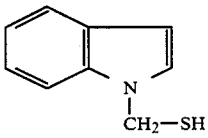
(III-31)
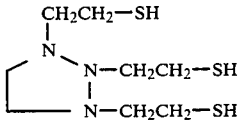
(III-32)
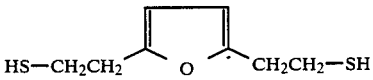
(III-33)
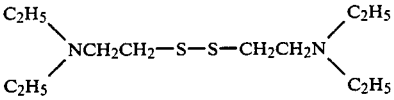
(III-34)
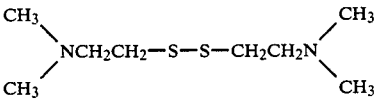
(III-35)
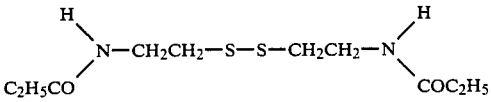
(III-36)
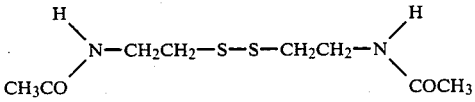
(III-37)
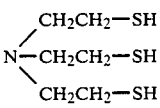

-continued
[Exemplary compounds]
(IV-1)
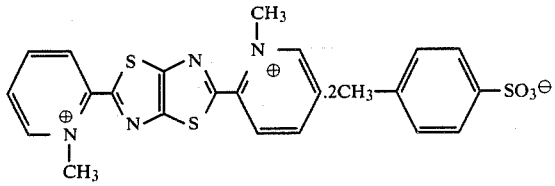
(IV-2)
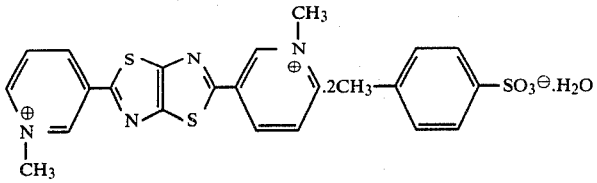
(IV-3)
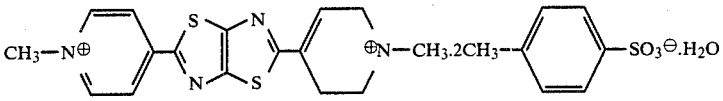
(IV-4)
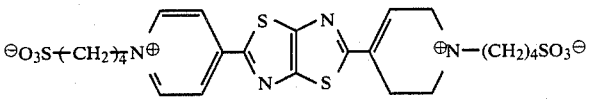
(IV-5)
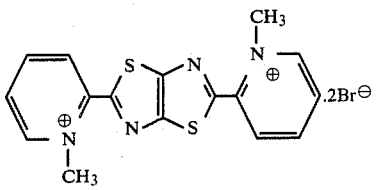
(V-1)
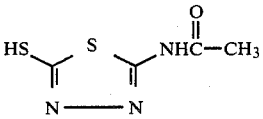
(V-2)
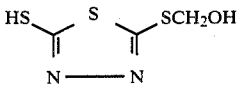
(V-3)
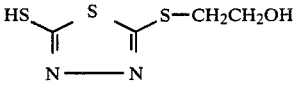
(V-4)
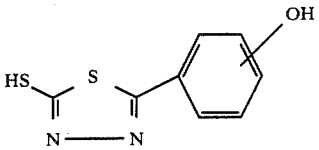
(V-5)
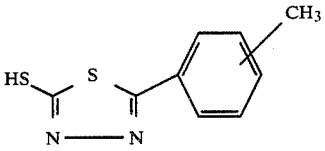
(V-6)
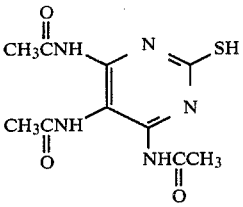
(V-7)
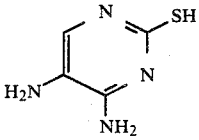
(V-8)
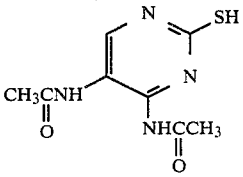

-continued
[Exemplary compounds]
(V-9)
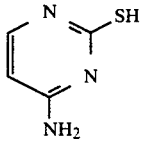
(V-10)
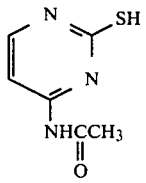
(V-11)
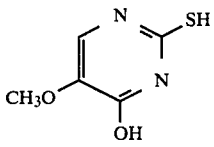
(V-12)
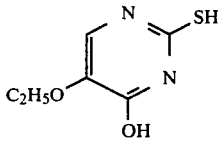
(V-13)
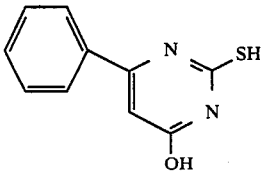
(V-14)
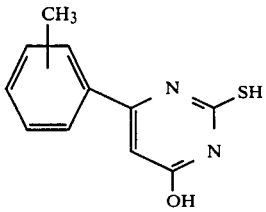
(V-15)
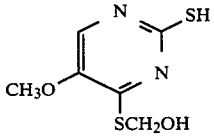
(V-16)
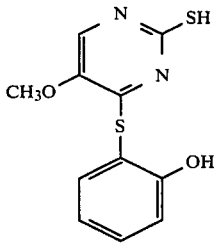
(V-17)
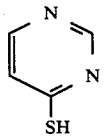
(V-18)
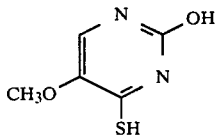
(V-19)
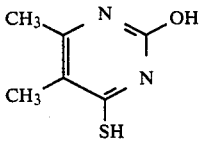
(V-20)
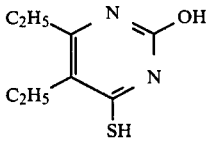
(V-21)
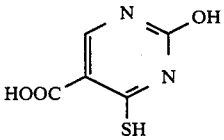
(V-22)
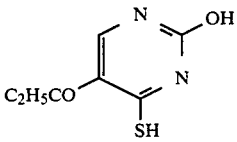
(V-23)
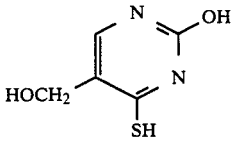
(V-24)
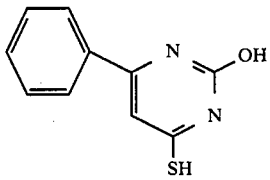
(V-25)
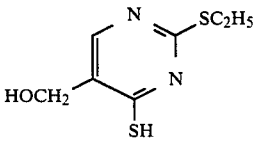
(V-26)
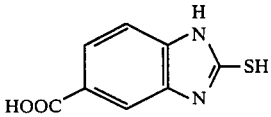

-continued
[Exemplary compounds]
(V-27)
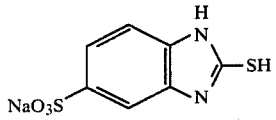
(V-28)
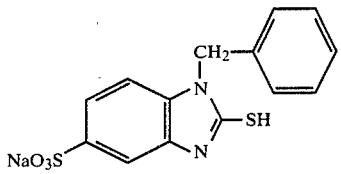
(V-29)
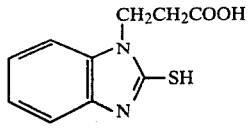
(V-30)
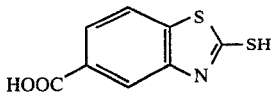
(V-31)
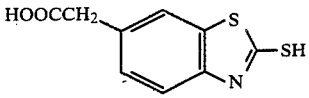
(V-32)
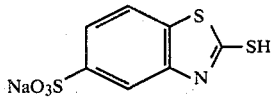
(V-33)
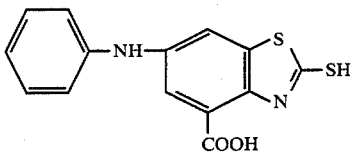
(V-34)
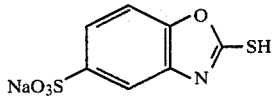
(V-35)
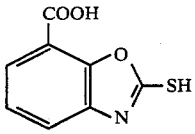
(V-36)
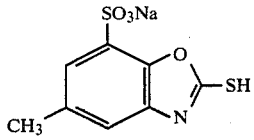
(V-37)
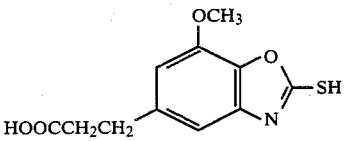
(V-38)
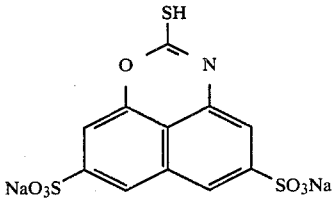
(V-39)
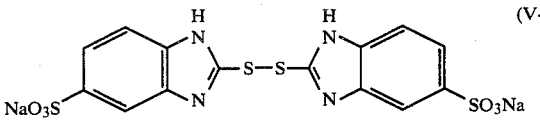
(V-40)
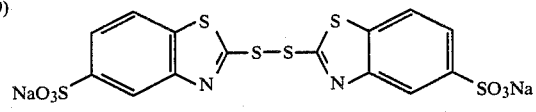
(V-41)
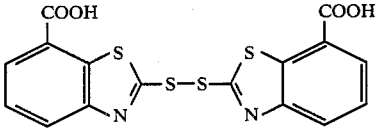
(V-42)
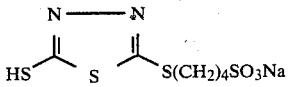
(V-43)
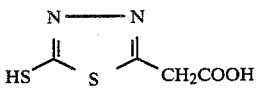
(V-44)
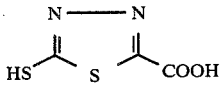
(V-45)
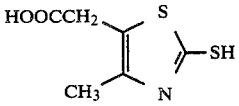
(V-46)
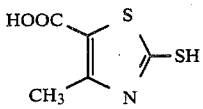
(V-47)
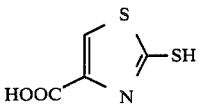
(V-48)
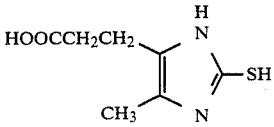

-continued
[Exemplary compounds]
(V-49)
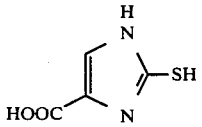
(V-50)
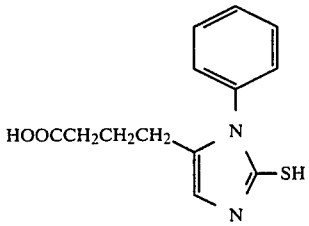
(V-51)
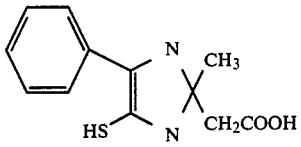
(V-52)
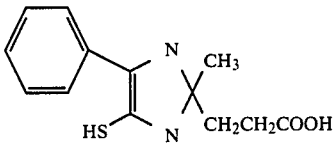
(V-53)
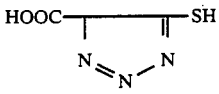
(V-54)
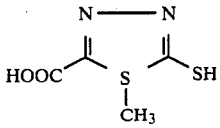
(V-55)
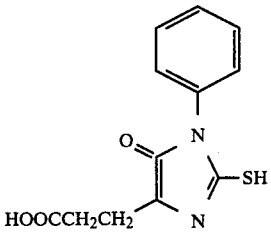
(V-56)
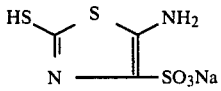
(V-57)
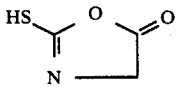
(V-58)
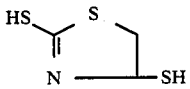
(V-59)
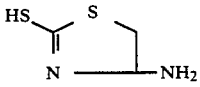
(V-60)
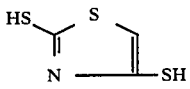
(V-61)
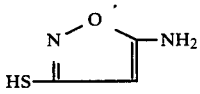
(V-62)
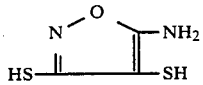
(V-63)
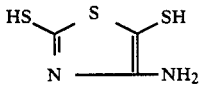
(V-64)
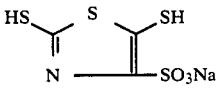
(V-65)
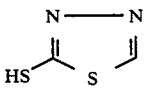
(V-66)
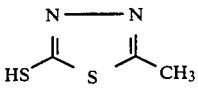
(V-67)
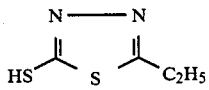
(V-68)
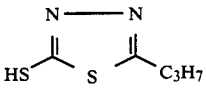
(V-69)
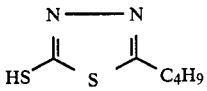
(V-70)
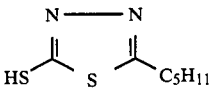
(V-71)
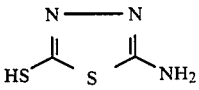
(V-72)
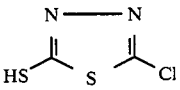

-continued
[Exemplary compounds]
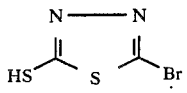
(V-73)
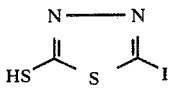
(V-74)
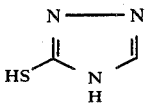
(V-75)
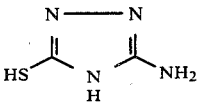
(V-76)
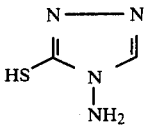
(V-77)
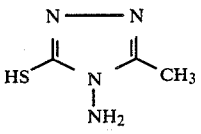
(V-78)
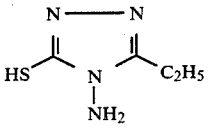
(V-79)
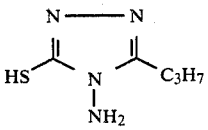
(V-80)
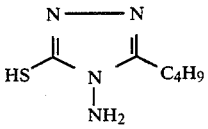
(V-81)
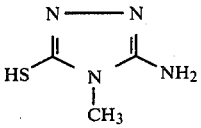
(V-82)
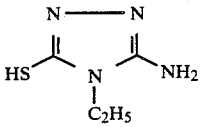
(V-83)
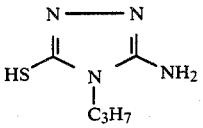
(V-84)
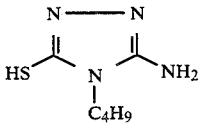
(V-85)
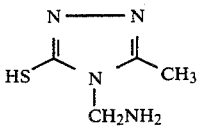
(V-86)
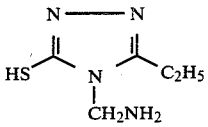
(V-87)
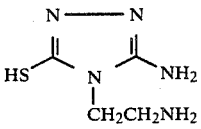
(V-88)
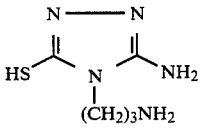
(V-89)
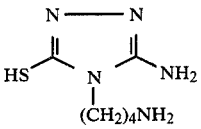
(V-90)
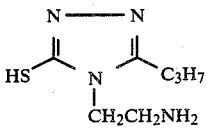
(V-91)
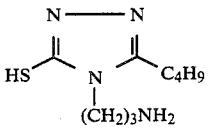
(V-92)
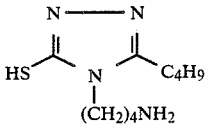
(V-93)
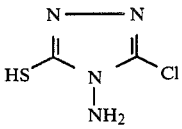
(V-94)

-continued
[Exemplary compounds]
(V-95)
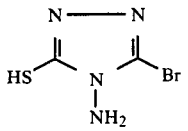
(V-96)
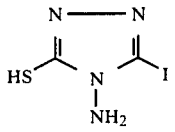
(V-97)
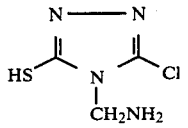
(V-98)
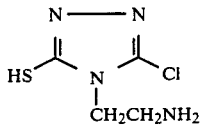
(V-99)
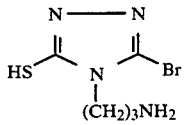
(V-100)
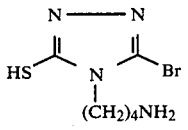
(V-101)
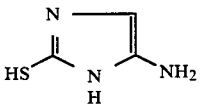
(V-102)
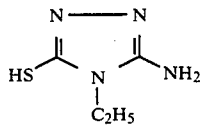
(V-103)
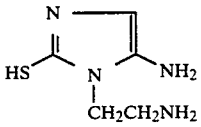
(V-104)
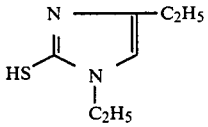
(V-105)
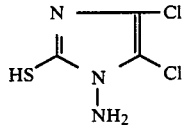
(V-106)
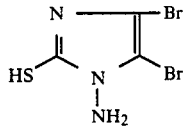
(V-107)
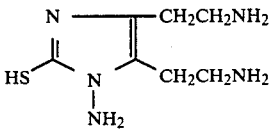
(V-108)
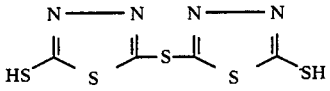
(V-109)
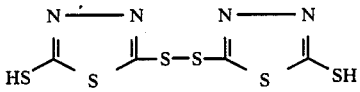
(V-110)
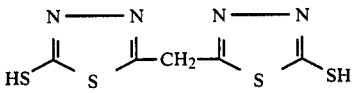
(V-111)
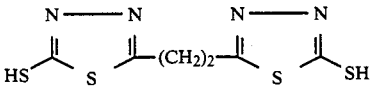
(V-112)
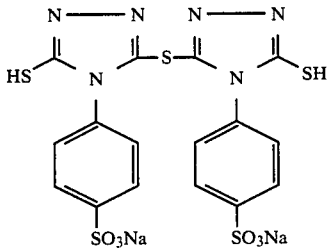
(V-113)
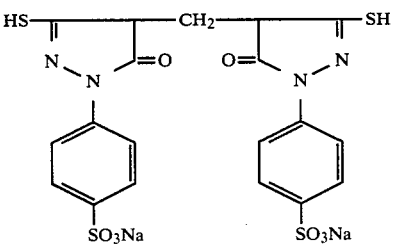
(V-114)
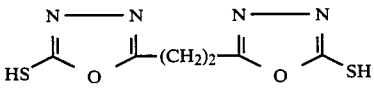

-continued
[Exemplary compounds]
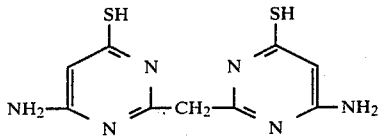
(V-115)
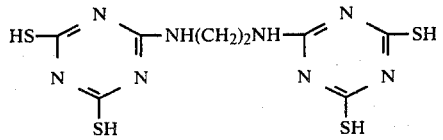
(V-116)
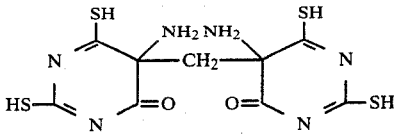
(V-117)
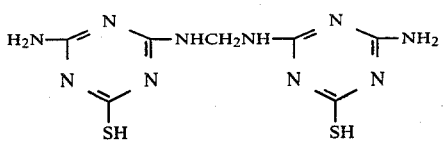
(V-118)
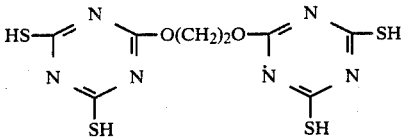
(V-119)
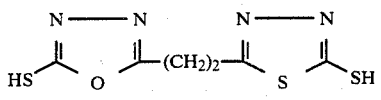
(V-120)
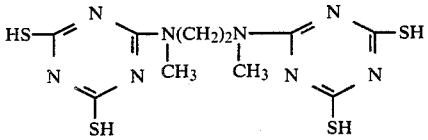
(V-121)
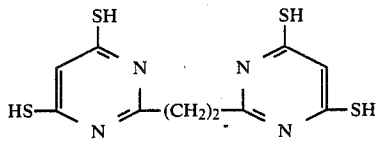
(V-122)
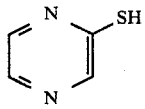
(V-123)
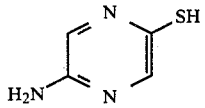
(V-124)
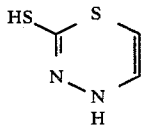
(V-125)
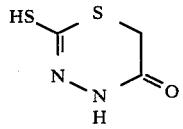
(V-126)
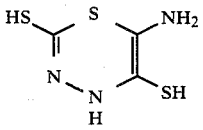
(V-127)
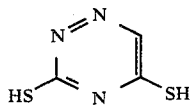
(V-128)
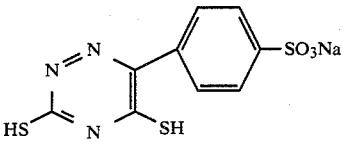
(V-129)
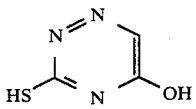
(V-130)
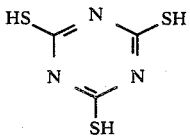
(V-131)
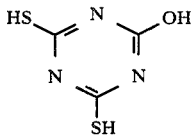
(V-132)
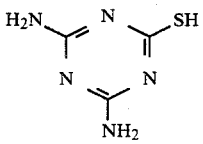
(V-133)
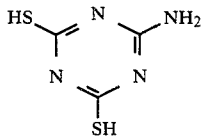
(V-134)

-continued
[Exemplary compounds]
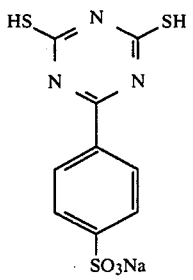
(V-135)
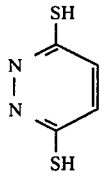
(V-136)
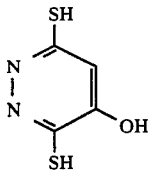
(V-137)
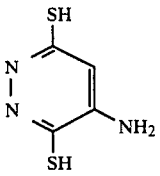
(V-138)
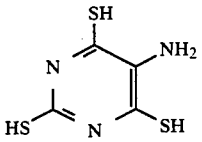
(V-139)
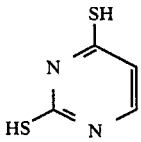
(V-140)
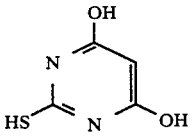
(V-141)
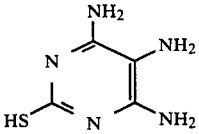
(V-142)
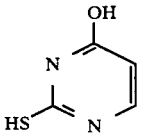
(V-143)
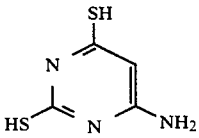
(V-144)
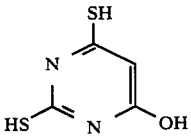
(V-145)
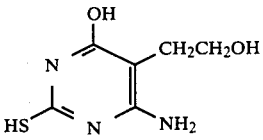
(V-146)
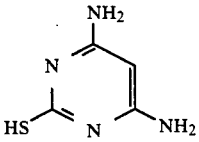
(V-147)
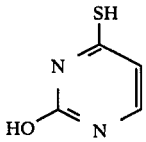
(V-148)
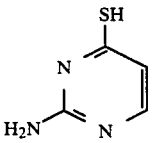
(V-149)
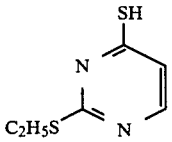
(V-150)
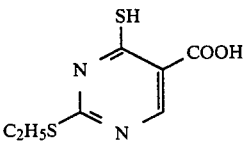
(V-151)
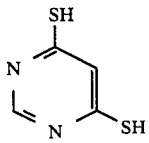
(V-152)

-continued
[Exemplary compounds]
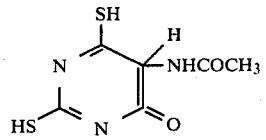
(V-153)
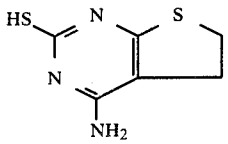
(V-154)
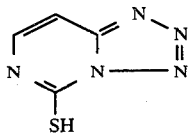
(V-155)
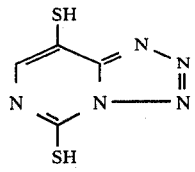
(V-156)
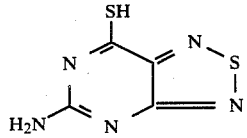
(V-157)
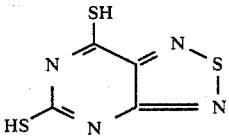
(V-158)
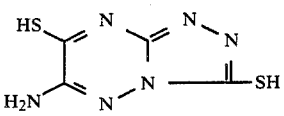
(V-159)
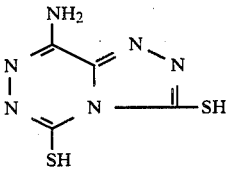
(V-160)
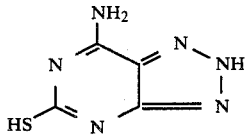
(V-161)
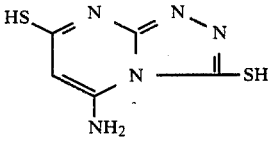
(V-162)
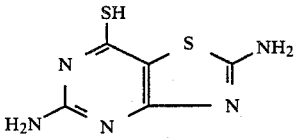
(V-163)
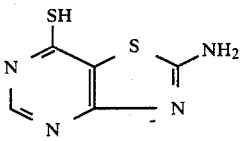
(V-164)
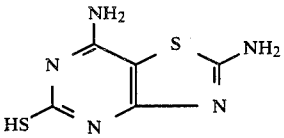
(V-165)
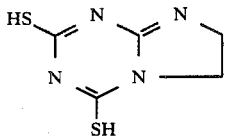
(V-166)
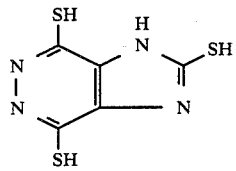
(V-167)
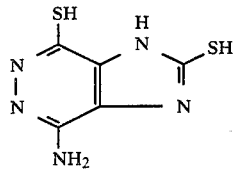
(V-168)
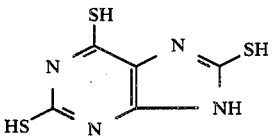
(V-169)
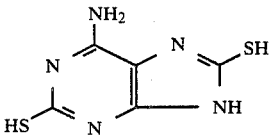
(V-170)
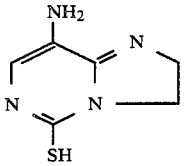
(V-171)
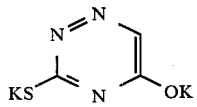
(V-172)

-continued
[Exemplary compounds]
(V-173)
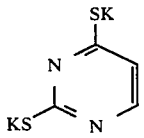
(V-174)
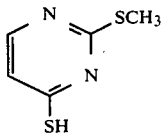
(V-175)
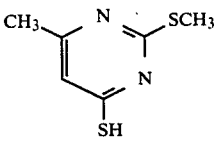
(V-176)
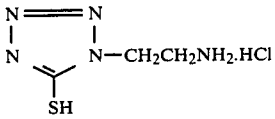
(V-177)
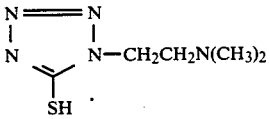
(V-178)
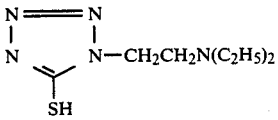
(V-179)
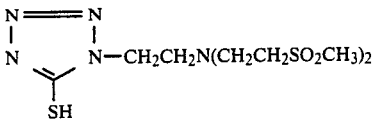
(V-180)
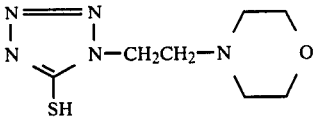
(V-181)
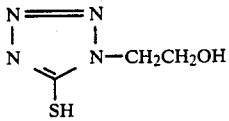
(V-182)
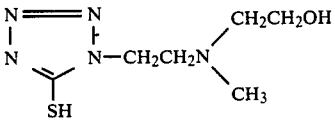
(V-183)
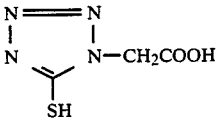
(V-184)
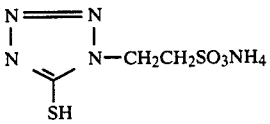
(VI-1)
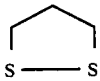
(VI-2)
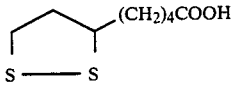
(VI-3)
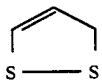
(VI-4)
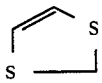
(VI-5)
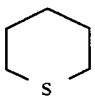
(VI-6)
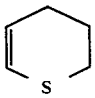
(VI-7)
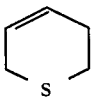
(VI-8)
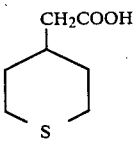
(VI-9)
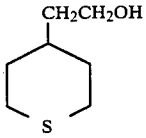
(VI-10)
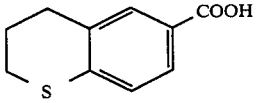
(VI-11)
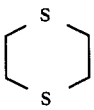
(VI-12)
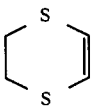

-continued
[Exemplary compounds]
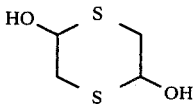
(VI-13)
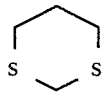
(VI-14)
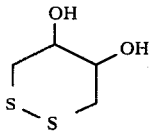
(VI-15)
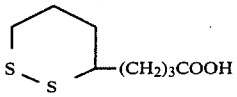
(VI-16)
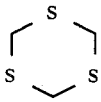
(VI-17)
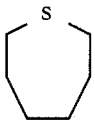
(VI-18)
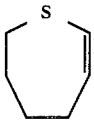
(VI-19)
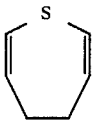
(VI-20)
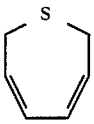
(VI-21)
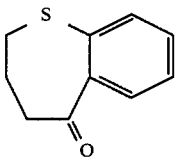
(VI-22)
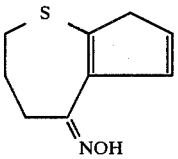
(VI-23)
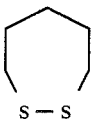
(VI-24)
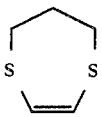
(VI-25)
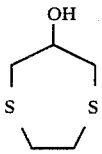
(VI-26)
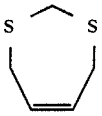
(VI-27)
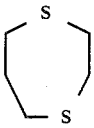
(VI-28)
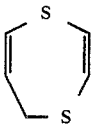
(VI-29)
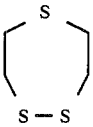
(VI-30)
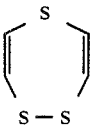
(VI-31)
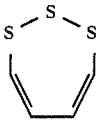
(VI-32)

-continued
[Exemplary compounds]
(VI-33)
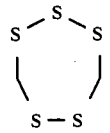
(VI-34)
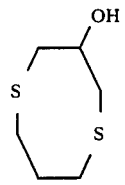
(VI-35)
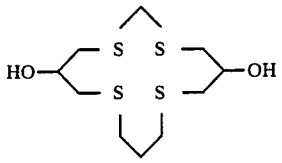
(VI-36)
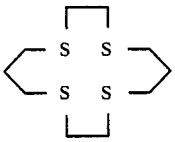
(VII-1)
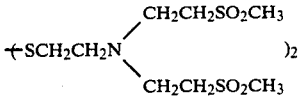
(VII-2)
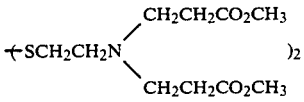
(VII-3)
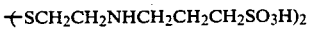
(VII-4)
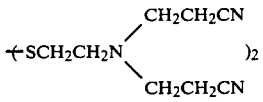
(VII-5)
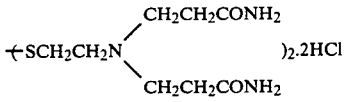
(VII-6)
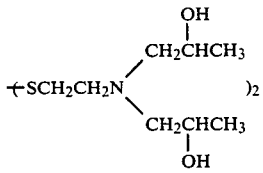
(VII-7)
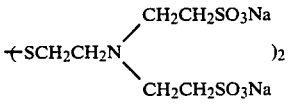
(VII-8)
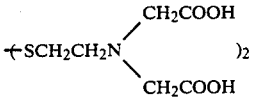
(VII-9)
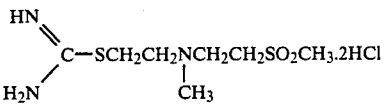
(VII-10)
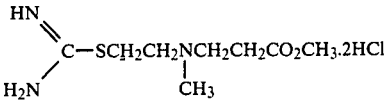
(VII-11)
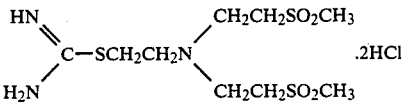
(VII-12)
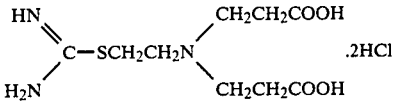
(VII-13)
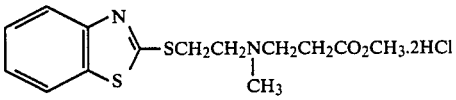
(VII-14)
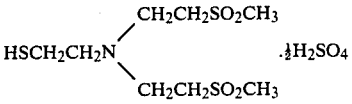
(VII-15)
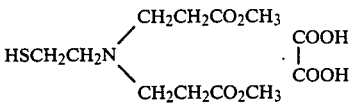
(VII-16)
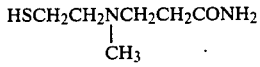
(VII-17)
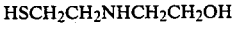
(VII-18)
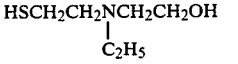
(VII-19)
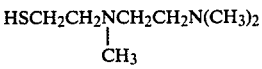
(VII-20)
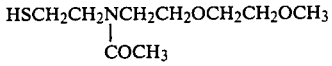
The above compounds may be synthesized easily according to the known techniques as disclosed in, for example, Great Britain Pat. No. 1,138,842, Japanese Provisional Patent Publications No. 20832/1977, No. 28426/1978, No. 95630/1978, No. 104232/1978, No. 141623/1978, No. 17123/1980 and No. 95540/1985, U.S. Pat. Nos. 3,232,936, 3,772,020, 3,779,757 and 3,893,858.

The bleaching accelerator of the present invention may be present in bleaching the silver image obtained by developing, and it is preferred to employ the method to add the accelerator in the bleach-fixing bath, and it is also preferred to employ the method to add the accelerator in the bath prior to the bleach-fixing bath (pre-processing solution, particularly pre-fixing processing solution), to incorporate it into the bleach-fixing bath carried by the light-sensitive silver halide color photographic material. More preferably, the accelerator should be present in both the pre-fixing processing solution and the bleach-fixing solution. In this case, the accelerator may be permitted to be present in the pre-fixing solution and brought into the bleach-fixing solution by the photographic material to be processed. Alternatively, it may be incorporated previously in the color light-sensitive material during preparation so as to be present during processing in the pre-processing bath or the bleach-fixing bath.

These bleaching accelerators of the present invention may be used either singly or as a combination of two or more compounds, and the amount of said bleaching accelerator to be added into the bleach-fixing solution or the baths preceding thereto (pre-processing solution, particularly pre-fixing solution) may be generally about 0.01 to 100 g per one liter of each processing solution to give favorable results. However, the bleaching accelerating effect will be small if the amount added is too small, while an excessive amount will result in formation of precipitates to contaminate the color light-sensitive material to be processed. Accordingly, it is preferred to use 0.05 to 50 g, more preferably 0.05 to 15 g, per liter of the processing solution.

When the bleaching accelerator is to be added in the bleach-fixing bath and/or the bath prior to the bleach-fixing bath (pre-processing bath, particularly pre-fixing bath), it may be added as such to be dissolved, but it is a general practice to add the accelerator as a solution previously dissolved in water, alkali, organic acid, etc. If desired, it is also possible to add the accelerator dissolved in an organic solvent such as methanol, ethanol, acetone, etc. without any deleterious effect on its bleach-fixing effect.

Into the bleach-fixing solution of the present invention, metal ions should desirably be supplied according to any method in order to enhance bleach-fixing characteristic. For example, they can be supplied in any desired form such as halides, hydroxides, sulfates, phosphates, acetates, etc., but preferably in the form of complexes with chelating agents as the compounds shown below (the metal compounds supplying these metal ions are hereinafter called metal compounds of the present invention). But, these supplying methods are not particularly limited. The chelating agent may be any compound such as organic polyphosphoric acid, aminopolycarboxylic acid, etc.

[Exemplary compounds]

(A-1) Nickel chloride
(A-2) Nickel nitrate
(A-3) Nickel sulfate
(A-4) Nickel acetate
(A-5) Nickel bromide
(A-6) Nickel iodide
(A-7) Nickel phosphate
(A-8) Bismuth chloride
(A-9) Bismuth nitrate
(A-10) Bismuth sulfate
(A-11) Bismuth acetate
(A-12) Zinc chloride
(A-13) Zinc bromide
(A-14) Zinc sulfate
(A-15) Zinc nitrate
(A-16) Cobalt chloride
(A-17) Cobalt nitrate
(A-18) Cobalt sulfate
(A-19) Cobalt acetate
(A-20) Cerium sulfate
(A-21) Magnesium chloride
(A-22) Magnesium sulfate
(A-23) Magnesium acetate
(A-24) Calcium chloride
(A-25) Calcium nitrate
(A-26) Barium chloride
(A-27) Barium acetate
(A-28) Barium nitrate
(A-29) Strontium chloride
(A-30) Strontium acetate
(A-31) Strontium nitrate
(A-32) Manganese chloride
(A-33) Manganese sulfate
(A-34) Manganese acetate
(A-35) Lead acetate
(A-36) Lead nitrate
(A-37) Titanium chloride
(A-38) Stannous chloride
(A-39) Zirconium sulfate
(A-40) Zirconium nitrate
(A-41) Ammonium vanadate
(A-42) Ammonium metavanadate
(A-43) Sodium tungstate
(A-44) Ammonium tungstate
(A-45) Aluminum chloride
(A-46) Aluminum sulfate
(A-47) Aluminum nitrate
(A-48) Yttrium sulfate
(A-49) Yttrium nitrate
(A-50) Yttrium chloride
(A-51) Samarium chloride
(A-52) Samarium bromide
(A-53) Samarium sulfate
(A-54) Samarium nitrate
(A-55) Ruthenium sulfate
(A-56) Ruthenium chloride These metal compounds of the present invention may be used either singly or as a combination of two or more compounds, in amounts of 0.0001 to 2 moles, particularly preferably 0.001 to 1 mole as the metal per mole of the solution used.

The bleaching accelerator of the present invention is represented by the above formulae [I]–[VII], in which heterocyclic residues, amino groups, aryl groups, alkenyl groups and alkylene groups represented by $R^1$, $R^2$, $R^3$, $R^4$, $R^5$, $R^8$, $R^9$, A, B, D, Z, Z', R, R', and formed by R and R', $R_2$ and $R^3$, $R^4$ and $R^5$, and Q, Q' may be substituted.

The substituents may include an alkyl group, an aryl group, an alkenyl group, a cyclic alkyl group, an aralkyl group, a cyclic alkenyl group, a halogen atom, a nitro group, a cyano group, an alkoxy group, an aryloxy group, a carboxy group, an alkoxycarbonyl group, an aryloxycarbonyl group, a sulfo group, a sulfamoyl group, a carbamoyl group, an acylamino group, a heterocyclic residue, an arylsulfonyl group, an alkylsulfonyl group, an alkylamino group, a dialkylamino group, an anilino group, an N-alkylanilino group, an N-arylanilino group, an N-aceylanilino group, a hydroxyl group, etc. The alkyl group represented by the above $R^1$–$R^5$, $R^8$, $R^9$, A, B, Z', R, R' may also have substituents, and said substituents may include those as enumerated above except for alkyl groups.

The bleach-fixing solution of the present invention contains an organic acid ferric complex (hereinafter called to as an organic acid ferric complex of the present invention) as the bleaching agent.

Typical examples of the organic acid forming the organic acid ferric complex of the present invention may include the following:

(1) Diethylenetriaminepentaacetic acid (MW=393.27)
(2) Diethylenetriaminepentamethylenephosphonic acid (MW=573.12)
(3) Cyclohexanediaminotetraacetic acid (MW=364.35)
(4) Cyclohexanediaminetetramethylenephosphonic acid (MW=508.23)
(5) Triethylenetetraminehexaacetic acid (MW=494.45)
(6) Triethylenetetraminehexamethylenephoshonic acid (MW=710.27)
(7) Glycoletherdiaminetetraacetic acid (MW=380.35)
(8) Glycoletherdiaminetetramethylenphosphonic acid (MW=524.23)
(9) 1,2-Diaminopropanetetraacetic acid (MW=306.27)
(10) 1,2-Diaminopropanetetramethylenephoshonic acid (MW=450.15)
(11) 1,3-Diaminopropane-2-ol-tetraacetic acid (MW=322.27)
(12) 1,3-Diaminopropane-2-ol-tetramethylenephosphonic acid (MW=466.15)
(13) Ethylenediaminediorthohydroxyphenylacetic acid (MW=360.37)
(14) Ethylenediaminediorthohydroxyphenylphosphonic acid (MW=432.31)
(15) Ethylenediaminetetramethylenephosphonic acid (MW=436.13)
(16) Ethylenediaminetetraacetic acid (MW=292.25)
(17) Nitrilotriacetic acid (MW=191.14)
(18) Nitrilotrimethylenephosphonic acid (MW=299.05)
(19) Iminodiacetic acid (MW=133.10)
(20) Iminodimethylenephosphonic acid (MW=205.04)
(21) Methyliminodiacetic acid (MW=147.13)
(22) Methyliminodimethylenephosphonic acid (MW=219.07)
(23) Hydroxyethyliminodiacetic acid (MW=177.16)
(24) Hydroxyethyliminodimethylenephosphonic acid (MW=249.10)
(25) Ethylenediaminetetrapropionic acid (MW=343.35)
(26) Dihydroxyethylglycine (MW=163.17)
(27) Nitrilotripropionic acid (MW=233.22)
(28) Ethylenediaminediacetic acid (MW=176.17)
(29) Ethylenediamine dipropionic acid (MW=277.15)

The organic acid ferric complex of the present invention is not limited to these examples, but any one of these compounds may be selected, and it is also possible to use a combination of two or more compounds, if desired.

Among the organic acids forming the organic acid ferric complex of the present invention, particularly preferable ones include the following:

(1) Diethylenetriaminepentaacetic acid (MW=393.27)
(3) Cyclohexanediaminotetraacetic acid (MW=364.35)
(5) Triethylenetetraminehexaacetic acid (MW=494.45)
(7) Glycoletherdiaminetetraacetic acid (MW=380.35)
(9) 1,2-Diaminopropanetetraacetic acid (MW=306.27)
(11) 1,3-Diaminopropane-2-ol-tetraacetic acid (MW=322.27)
(13) Ethylenediaminediorthohydroxyphenylacetic acid (MW=360.37)
(16) Ethylenediaminetetraacetic acid (MW=292.25)
(19) Iminodiacetic acid (MW=133.10)
(21) Methyliminodiacetic acid (MW=147.13)
(23) Hydroxyethyliminodiacetic acid (MW=177.16)
(25) Ethylenediaminetetrapropionic acid (MW=343.35)
(26) Dihydroxyethylglycine (MW=163.17)
(27) Nitrilotripropionic acid (MW=233.22)
(28) Ethylenediaminediacetic acid (MW=176.17)
(29) Ethylenediamine dipropionic acid (MW=277.15)

The organic acid ferric complex of the present invention may be used as free acid (hydrogen), alkali metal salt such as sodium salt, potassium salt, lithium salt, etc. or ammonium salt, or a water soluble amine salt such as triethanolamine salt, etc. Preferably, potassium salt, sodium salt and ammonium salt may be used. At least one of these ferric complex salts may be used, and it is possible to use two or more compounds in combination. The amount to be used may be chosen as desired and it is required to be chosen depending on the amount of silver and the silver halide composition in the light-sensitive material to be processed.

More specifically, it is preferred to employ 0.01 mole or more, more preferably 0.05 to 1.0 mole, per one liter of the solution employed. In the supplemental solution, for supplementing smaller amount of more concentrated solution, the supplemental solution should desirably be employed at the maximum concentration as permitted by the solubility.

The bleach-fixing solution of the present invention should preferably be used at pH 2.0 to 10.0, more preferably at pH 3.0 to 9.5, most preferably at pH 4.0 to 9.0. The temperature for processing should desirably be 80° C. or lower, more desirably 55° C. or lower, most desirably 45° C. or lower, for the purpose of suppressing evaporation, etc. The bleach-fixing processing time should preferably be within 8 minutes, more preferably within 6 minutes.

The bleach-fixing solution of the present invention can contain various additives together with the organic acid ferric complex as the bleaching agent as described above. As the additives which can contribute to bleach-fixing characteristic, it is desirable to incorporate particularly alkali halides or ammonium halides, such as potassium bromide, sodium bromide, sodium chloride, ammonium bromide, ammonium iodide, sodium iodide, potassium iodide, etc. It is also possible to use suitably solubilizing agents such as triethanolamine, etc. or those generally known to be added in bleaching solution such as acetylacetone, phosphonocarboxylic acid, polyphosphoric acid, organic phosphonic acid, oxycarboxylic acid, polycarboxylic acid, alkylamines, polyethyleneoxides, etc.

For the bleach-fixing solution of the present invention, it is also possible to use a special bleach-fixing solution such as a bleach-fixing solution comprising a composition in which a halide such as potassium bromide is added in a small amount, or contrariwise a bleach-fixing solution in which a halide such as potassium bromide, ammonium bromide and/or ammonium iodide, potassium iodide is added in a large amount, and further a bleach-fixing solution with a composition comprising a combination of the bleaching agent of the present invention and a large amount of a halide such as potassium bromide.

The silver halide fixing agent to be incorporated in the bleach-fixing solution of the present invention may be a compound used conventionally in fixing processing which can react with a silver halide to form a water soluble complex, including thiosulfates such as potassium thiosulfate, sodium thiosulfate, ammonium thiosulfate, etc., thiocyanates such as potassium thiocyanate, sodium thiocyanate, ammonium thiocyanate, thiourea, thioether, highly concentrated bromides, iodides, etc. as typical examples. These fixing agents may be used in amounts within the range which can be dissolved, namely 5 g/liter or more, preferably 50 g/liter or more, more preferably 70 g/liter or more.

The bleach-fixing solution of the present invention may also contain various pH buffers such as boric acid, borax, sodium hydroxide, potassium hydroxide, sodium carbonate, potassium carbonate, sodium bicarbonate, acetic acid, sodium acetate, ammonium hydroxide, etc. either singly or in a combination of two or more compounds. Further, various fluorescent whitening agents, defoaming agents or antifungal agents may also be contained in the bleach-fixing solution. Also, preservatives such as hydroxylamine, hydrazine, sulfites, metabisulfites, bisulfite adducts of aldehyde or ketone compounds, other additives, or organic solvents such as methanol, dimethylformamide, dimethyl sulfoxide, etc. may be contained, as desired. Further, it is desirable to add a polymer or a copolymer having a vinyl pyrrolidone nucleus as disclosed in Japanese Provisional Patent Publication No. 10303/1985.

As other desirable compounds to be added in the bleach-fixing solution of the present invention for accelerating bleach-fixing characteristics, there may be included tetramethylurea, phosphoric trisdimethylamide, ε-caprolactam, N-methylpyrrolidone, N-methylmorpholine, tetraethyleneglycol monophenyl ether, acetonitrile, glycol monomethyl ether, etc.

In the processing method of the present invention, it is preferred that the bleach-fixing of the present invention should be performed immediately after color developing, but it is also possible to carry out the bleach-fixing processing of the present invention following the processing such as water washing, rinsing or stopping, etc. after color developing. Most preferably, after pre-fixing processing carried out after color developing as mentioned above, the bleach-fixing processing of the present invention should be conducted, and, in this case, the bleaching accelerator of the present invention may be incorporated in said pre-fixing processing.

The bleach-fixing processing may be followed by stabilizing processing without washing with water or alternatively followed by washing with water before stabilizing processing. In addition to the above steps, there may also be added various auxiliary steps such as of film hardening, neutralization, black-and-white developing, reversal, washing with a small amount of water, etc., if desired. Typical examples of preferable processing methods may include the various steps as shown below:

(1) Color developing→Bleach-fixing→Water washing
(2) Color developing→Bleach-fixing→Washing with a small amount of water→Water washing
(3) Color developing→Bleach-fixing→Water washing →Stabilizing
(4) Color developing→Bleach-fixing→Stabilizing
(5) Color developing→Bleach-fixing→First stabilizing→Second stabilizing
(6) Color developing→Water washing (or stabilizing)→Bleach-fixing→Water washing (or stabilizing)
(7) Color developing→Pre-fixing→Bleach-fixing→Water washing
(8) Color developing→Pre-fixing→Bleach-fixing→Stabilizing
(9) Color developing→Pre-fixing→Bleach-fixing→First stabilizing→Second stabilizing
(10) Color developing→Stopping→Bleach-fixing→Water washing→Stabilizing.

Of these processing steps, those of (3), (4), (5), (8) and (9) may preferably be employed in the present invention, because the effect of the present invention can be exhibited more markedly. And, most preferred are the processing steps of (4), (5), (8) and (9).

In the bleach-fixing solution of the present invention, various inorganic metal salts should preferably be added. These inorganic metal salts may be added preferably after formation of metal complexes together with various chelating agents.

In the bleach-fixing solution of the present invention, chelating agents and/or ferric complexes thereof outside the scope of the present invention may be added. However, it is preferred to use the ferric complex outside the scope of the present invention at a proportion of 0.45 mole % or less relative to the organic acid ferric complex of the present invention.

As described above, it is preferred to incorporate the bleaching accelerator of the present invention in the pre-fixing solution, and most preferably the bleach-fixing solution also contains the bleaching accelerator. However, it will be suffice to incorporate the bleaching accelerator in either one of them. When the bleaching accelerator is contained in only the pre-fixing solution, said bleaching accelerator will be carried by the color light-sensitive material from the pre-fixing solution to be brought into the bleach-fixing solution to exhibit its effect therein.

In the bleach-fixing solution, for returning the reduced product of the iron complex formed in the bleach-fixing solution to the oxidized product, it is preferable to apply an oxidation treatment. As said oxidation treatment, there may be employed the air oxidation step. The air oxidation step as herein mentioned refers to a compulsory oxidation treatment in which oxidation treatment is carried out by introducing compulsorily air bubbles into the processing solution in the bleaching solution tank or the bleach-fixing solution tank in an automatic developing machine to be contacted therewith for oxidation treatment. This means, involving also oxidation by natural contact of the air on the liquid surface, is generally called aeration, and oxidation should desirably be conducted with high oxidation efficiency through contact of the bubbles delivered from the tank bottom with the processing solution, while making the contact area with the solution as large as possible by permitting the air delivered from a device such as a compressor to pass through a diffuser having micropores such as an air distributor thereby making the sizes of the air bubbles as small as possible for enhancement of the oxidation efficiency.

Such aeration is conducted primarily in the processing tank, but may also be conducted batchwise in a separate tank, or alternatively in an auxiliary tank for aeration equipped on the side of the tank. Particularly, when carrying out regeneration of the bleaching solution or the bleach-fixing solution, it should be conducted outside of the tank solution. In the present invention, since no overaeration is conceivable, aeration may be conducted throughout the whole processing time, or strong aeration may be effected intermittently, or any other desired method may be adopted. However, the bubble size of the air should be as small as possible for better efficiency, whereby entrainment of air bubbles into other solutions can be prevented by splash, etc. Also, in the present invention, it is preferred to effect aeration during stopping of the automatic processor, and to stop aeration during processing. Aeration may also be conducted separtely by leading the solution to outside of the processing solution. For aeration as described above, there may be employed in combination the shower system, the spray system and the jet atomizing system as disclosed in Japanese Provisional Patent Publications Nos. 55336/1974, 9831/1976 and 95234/1979, and the method as disclosed in West German OLS No. 21 13 651 may also be available.

The total amount of silver coated in the color light-sensitive material to be used in the present invention is the value including the contents in the colloid silver filter layer and the colloid silver halation preventive layer, which is required to be 80 mg/dm$^2$ or less to exhibit the effect of the present invention. Preferably, it should be 60 mg/dm$^2$ or less, particularly preferably 50 mg/dm$^2$ or less to exhibit the effect of the present invention. With respect to photographic performance, a quantity of 20 mg/dm$^2$ or more of silver is preferred for exhibiting good effect of the present invention.

The film thickness of the photographic constituent layer in the color light-sensitive material of the present invention (gelatin film thickness) refers to the total film thickness, the thickness of the dried photographic constituent layer, including all the hydrophilic colloid layers except for the support, namely the subbing layer, the halation preventive layer, the intermediate layer, at least three emulsion layers, the filter layer, the protective layer, etc. The thickness is measured by a micrometer, and the total thickness of the photographic constituent layer in the present invention is 25 μm or less, preferably 22 μm or less, particularly 20 μm or less, most preferably 18 μm or less. With respect to photographic performance, a total thickness of at least 8 μm is preferred for exhibiting good effect of the present invention.

The silver halide in the silver halide emulsion layer of the present invention contains at least 0.5 mole % of silver iodide grains, but preferably 0.5 mole % to 25 mole % of silver iodide should be contained with respect to photographic characteristics and bleach-fixing characteristic, in order to exhibit the sensitivity and photographic characteristics of the color light-sensitive material and the bleach-fixing performance of the present invention. In the present invention, at a level exceeding 25 mole %, although it may be preferred for photographic characteristics, bleach-fixing characteristic will markedly be lowered. In the present invention, the silver halide should more preferably contain 2 mole % to 20 mole % of silver iodide.

The black colloid silver dispersion layer for halation prevention to be used in the present invention has a sufficiently high optical density in the visible region (particularly red light) relative to the incident light from the support surface of the color light-sensitive material or the incident light from the emulsion surface. On the other hand, it has a sufficiently low reflectance relative to the incident light from the emulsion surface of the color light-sensitive material.

The above black colloid sivler dispersion layer should desirably consist of sufficiently fine particulate colloid silver in view of reflectance and bleach-fixing characteristic. However, since sufficiently fine particulate colloid silver will absorb primarily yellow to yellowish brown color without being increased in optical density to red light, it cannot but be constituted of somewhat coarse grains. As the result, physical phenomenon caused by these silver grains is liable to occur, whereby the bleach-fixing characteristic at the boundary with the silver halide emulsion layer may be considered to be worsened. Particularly, when the silver halide emulsion layer contains at least 0.5 mole % of silver iodide grains, the phenomenon of lowering in bleach-fixing characteristic will become marked particularly when the silver halide emulsion layer nearest to the support contains at least 0.5 mole % of silver iodide grains. This effect can be marked in a multi-layer color light-sensitive material having 3 layers or more of silver iodide containing layers, whereby the effect of the present invention may be estimated to be most marked.

In the present invention, the effect of the present invention can be exhibited most effectively when a light-sensitive material containing a core-shell emulsion is processed. Although a part of core-shell emulsions to be employed may be described in detail in, for example, Japanese Provisional Patent Publication No. 154232/1982, preferable color light-sensitive materials contain a core having silver halide composition containing 0.1 to 20 mole % of silver iodide, preferably 0.5 to 10 mole %, and a shell comprising silver bromide, silver chloride, silver iodobromide, silver chlorobromide or a mixture thereof.

Particularly desirably, the shell may be a silver halide emulsion comprising silver iodobomide or silver bromide. Also, in the present invention, a preferable effect may be exhibited by making the core substantially mono-dispersed silver halide grains and making the thickness of the shell 0.01 to 0.8 μm.

The color light-sensitive material of the present invention is characterized by comprising silver halide grains containing at least 0.5 mole % of silver iodide, having a halation preventive layer comprising black colloid silver as the lowest layer, having a total silver quantity coated of 80 mg/dm$^2$ or less, preferably 60 mg/dm$^2$ or less, particularly preferably 50 mg/cm$^2$ or less, and having a film thickness of the photographic constituent layer excluding the substrate (gelatin film thickness) of 25 μm or less, preferably 22 μm or less, further preferably 20 μm or less, particularly 18 μm or less. Particularly, its specific feature resides in employing silver halide grains containing silver iodide in the core and/or shell and shielding the core with a shell having a specific thickness as defined above of silver halide grains comprising silver bromide, silver chloride, silver chlorobromide or silver iodobromide or a mixture thereof, thereby utilizing the high sensitivity property inherent in silver halide grains containing silver iodide and shielding disadvantageous properties of said grains.

The silver halide emulsion having silver halide grains having shells with specific thicknesses as defined above can be prepared by coating the silver halide grains contained in a mono-dispersed emulsion as the cores with shells. The ratio of the silver iodide to silver bromide when the shell is silver iodobromide should preferably be made 20 mole % or less. For making the cores mono-dispersed silver halide grains, grains of desired sizes can be obtained according to the double jet method while maintaining pAg constant. Also, for preparation of highly mono-dispersed silver halide emulsions, the method as disclosed in Japanese Provisional Patent Publication No. 48521/1979 may be applicable. As a preferred embodiment of this method, it can be prepared by adding an aqueous potassium iodobromidegelatin solution and an aqueous ammoniacal silver nitrate solution into an aqueous gelatin solution containing silver halide seed grains according to the method in which the addition rate is varied as the function of time. In this method, by selecting suitably the time function of the addition rate, pH, pAg, temperature, etc., a highly mono-dispersed silver halide emulsion can be obtained.

The grain size distribution of a mono-dispersed emulsion will form substantially a Gaussian distribution, and therefore the standard deviation can easily be determined. Now, the broadness of distribution is defined by the relationship formula:

$$\frac{\text{Standard deviation}}{\text{Average grain size}} \times 100 = \text{broadness of distribution (\%)}$$

and then the broadness of distribution capable of withstanding significant regulation of the absolute thickness of coating may preferably be a mono-dispersibility of 20% or less, more preferably 10% or less.

Next, the thickness of the shell covering the core should be a thickness which does not shield the preferable property of the core, but can contrariwise sufficiently shield the unfavorable properties of the core. That is, the thickness is limited to a narrow range restricted by such upper and lower limits. Such a shell can be formed by depositing a soluble halide compound solution and a soluble silver solution according to the double jet method on the mono-dispersed core.

For example, according to the experiments in which substantially mono-dispersed silver halide grains with an average grain size of 1 μm containing 2 mole % of silver iodide were used as the core and shells of 0.2 mole % silver iodobromide were varied variously in coating thickness, when, for example, a shell with 0.85 μm thickness was prepared, the mono-dispersed silver halide grains according to this method were low in covering power. When these were processed with a processing solution having physical developability containing a solvent dissolving silver halide and observed with a scanning type electron microscope, it was found that no filament of developed silver appeared. This suggests lowering in optical density, and further lowering in covering power. Accordingly, in view of the filament form of the developed silver, the same experiment was conducted by making thinner the thickness of the shell of silver bromide on the surface while varying the average grain size of the core. As the result, it was found that a large number of good developed filaments were formed at an absolute thickness of the shell of 0.8 μm or less (preferably 0.5 μm or less) irrespective of the average grain size of the core to give rise to sufficient optical density, and without impairment of the property of high sensitization of the core.

On the other hand, if the thickness of the shell is too thin, the portion of the material of the core containing silver iodide will appear uncovered, whereby the effect of coating of the shell on the surface, namely the chemical sensitizing effect, the rapid developing and rapid fixing, etc. will be lost. The lower limit of its thickness should preferably be 0.01 μm.

Further, when confirmed with a highly mono-dispersed core with a distribution broadness of 10% or less, the preferable shell thickness is 0.01 to 0.06 μm, most preferably 0.03 μm or less.

Improvement of optical density through sufficient generation of developed silver filaments, generation of the sensitization effect through utilization of the property of high sensitization of the core and generation of rapid developability and fixability as described above can be effected due to the shell regulated in its thickness as described above by the highly mono-dispersed core as well as synergistic effect of the silver halide compositions of the core and the shell. Therefore, provided that the thickness regulation of the shell can be satisfied, the silver halide constituting said shell to be employed may be silver iodobromide, silver bromide, silver chloride or silver chlorobromide or a mixture thereof. Among them, with respect to compatibility with the core, performance stability or storability, silver bromide, silver iodobromide or a mixture of these may preferably be employed.

The light-sensitive silver halide emulsion to be used in the present invention may be applied with doping with various metal salts or metal complexes during formation by precipitation of the silver halide of the core and the shell, during growth of grains or after completion of the growth. For example, metal salts or complexes of gold, platinum, palladium, iridium, rhodium, bismuth, cadmium, copper, etc. and combinations thereof may be applicable.

The excessive halides formed during prepration of the emulsion to be used in the present invention or salts, compounds such as nitrates or ammonium salts which were by-produced or became unnecessary may be removed. The method for removing such compounds may include those conventionally used for emulsions in general such as the Noodel water washing method, the dialysis method or the coagulation precipitation method.

The emulsion to be used in the present invention may also be applied with various chemical sensitizing methods applied for emulsions in general. For example, chemical sensitization may be effected by using solely or in combination active gelatin; noble metal sensitizers such as water soluble gold salts, water soluble platinum salts, water soluble palladium salts, water soluble rhodium salts, water soluble iridium salts, etc.; sulfur sensitizers; selenium sensitizers; reductive sensitizers such as polyamine, stannous chloride, etc. Further, the silver halide can be optically sensitized to a desired wavelength region. The optical sensitizing method of the emulsion of the present invention is not particularly limited, but optical sensitization (e.g. color intensifying sensitization) may be possible by using singly or in combination, for example, cyan dyes such as zeromethyne dyes, monomethyne dyes, trimethyne dyes, etc. or merocyan dyes. These techniques are disclosed in U.S. Pat. Nos. 2,688,545, 2,912,329, 3,397,060, 3,615,635 and 3,628,964; U.K. Pat. No. 1,195,302, No. 1,242,588 and No. 1,293,862; West German Pat. (OLS) No. 2,030,326 and No. 2,121,780; and Japanese Patent Publications No. 4936/1968 and No. 14030/1969. These techniques can be selected as desired depending on the wavelength region to be sensitized, the sensitivity, the purpose and use of the light-sensitive materials.

The silver halide emulsion to be used in the present invention can further be obtained, in formation of the silver halide grains contained by using a silver halide emulsion comprising core grains of substantially mono-dispersed silver halide grains and covering shells over said core grains, as a mono-dispersed silver halide emulsion with a uniform shell thickness. Such a substantially mono-dispersed silver halide emulsion may be provided for use with such a grain size distribution, or alternatively two or more mono-dispersed dispersions with different average grain sizes may be blended at any desired stage after grain formation to be formulated so as to give a desired tone to intended use.

The silver halide emulsion to be used in the present invention should desirably contain the silver halide grains of the present invention at a proportion relative to the total silver halide grains contained in the emulsion which is equal to or more than the emulsion obtained by coating a substantially mono-dispersed core with a distribution broadness of 20% or less with a shell. However, other silver halide grains outside the scope of the present invention may also be contained within the range which does not interfere with the effect of the present invention. Said other silver halide outside the scope of the present invention may be either core-shell type or other than core-shell type, and it may be either mono-dispersed or poly-dispersed. In the silver halide emulsion to be used in the present invention, at least 65% by weight of the silver halide grains contained in said emulsion should preferably comprise the silver halide grains of the present invention, desirably almost all thereof comprise the silver halide grains of the present invention.

The present invention is also inclusive of the case of an emulsion containing silver halide grains shaped in flat plates containing at least 0.5 mole % of silver iodide. Thus, the emulsion of the present invention to be used in the silver halide emulsion layer of the present invention is included within the present invention, irrespective of whether the silver halide grains may be (1) the core-shell grains containing silver iodide as described above; (2) the silver halide grains shaped in flat plates containing silver iodide (said silver halide grains shaped in flat plates containing silver iodide may be core-shell type or any other type); (3) a mixture of the above (1) and (2).

In the following, the silver halide grains shaped in flat plates containing silver iodide are explained.

The flat plate silver halide grains should preferably have grain sizes of 5-fold or more of the grain thickness. Said flat plate silver halide grains can be prepared according to the processes in general as disclosed in Japanese Provisional Patent Publications No. 113930/1983, No. 113934/1983, No. 127921/1983, No. 108532/1983, No. 99433/1984, No. 119350/1984, etc. In the present invention, with respect to the color stain and the effect on the image quality, it is preferred to use those having particle sizes of 5-fold or more, preferably 5 to 100-fold, particularly preferably 7 to 30-fold, of the grain thickness. Further, particle sizes of 0.3 μm or more are preferred, and those with particle sizes of 0.5 to 6 μm are particularly preferred. The flat plate silver halide grains, when processing a light-sensitive material having a layer containing 50% by weight or more of such grains in at least one layer of silver halide emulsions, can exhibit more preferably the effect of the present invention, and a particularly preferably effect can be exhibited when most of the silver halide emulsion layers comprise the above flat plate silver halide emulsions.

The flat plate silver halide grains are particularly useful when they are core-shell type. And, when they are core-shell type, it is preferred that the requirements as described above for core-shell should also be satisfied.

Generally speaking, a flat plate silver halide grain is shaped in a flat plate having two parallel planes, and therefore the "thickness" in the present invention is represented by the distance between the two parallel planes constituting the flat plate silver halide grain.

On the other hand, the "grain size" refers to the diameter of the projected face when the flat plate silver halide grain is viewed in the direction perpendicular to the flat surface, and when it is not circular, a circle with its longest length is assumed as its diameter, which is referred to as the grain size.

The halide composition of the flat plate silver halide grain should preferably be silver bromide and silver iodobromide, particularly a silver iodobromide containing 0.5 to 10 mole % of silver iodide.

Next, the method for preparation of flat plate silver halide grains is explained.

As the method for prepration of flat plate silver halide grains, those known in this field of the art can be combined suitably.

For example, they can be obtained by forming, in an atmosphere of a relatively high pAg value with pBr value of 1.3 or less, seed crystals in which flat plate silver halide grains exist at 40% by weight or more, and permitting the seed crystals to grow while maintaining substantially the same pBr value and adding at the same time a silver and a halide solutions.

In the course of the grain growth, it is desirable to add the silver and the halide solutions so that no new crystal nucleus may be generated.

The size of the flat plate silver halide grain can be controlled by temperature control, selection of the solvent and its amount, and controlling the addition rate of the silver salt and the halide to be used during grain growth.

By using optionally a silver halide solvent during preparation of the flat plate silver halide grains, the grain size, the grain shape (diameter/thickness ratio, etc.), the grain size distribution and the growth rate of grains can be controlled. The amount of the silver halide solvent should preferably be $1\times10^{-3}$ to 1.0% by weight, particularly preferably $1\times10^{-2}$ to $1\times10^{-1}$% by weight, of the reaction mixture.

For example, as the increase in the amount of the silver halide solvent employed, the silver halide grain size distribution may become more mono-dispersed, whereby the growth rate can be accelerated. On the other hand, the thickness of the silver halide grains also tend to be increased with the increase of the silver halide solvent employed.

The silver halide solvent to be employed may include ammonia, thioether, thioureas, etc. As for thioethers, reference may be made to U.S. Pat. Nos. 3,271,157, 3,790,387 and 3,574,628.

During preparation of flat plate silver halide grains, there may preferably be employed the methods of elevating the addition rate, the addition quantity and the addition concentration of a silver salt solution (e.g. aqueous $AgNO_3$ solution) and a halide solution (e.g. aqueous KBr solution) to be added for accelerating grain growth.

Concerning these methods, reference may be made to, for example, U.K. Pat. No. 1,335,925; U.S. Pat. Nos. 3,672,900, 3,650,757 and 4,242,445; and Japanese Provisional Patent Publications No. 142329/1980 and No. 158124/1980.

The flat plate silver halide grains can be chemically sensitized, if desired. As to said chemical sensitization method, reference may be made to the description about the sensitization method for the core-shell type. Particularly, in view of saving of silver, the flat plate silver halide grains of the present invention should preferably be sensitized according to gold sensitization or sulfur sensitization or a combination thereof.

In the layer containing the flat plate silver halide grains, said flat plate silver halide grains should preferably exist at a weight ratio of 40% or more, particularly 60% or more based on the total silver halide grains in said layer.

The thickness of the layer containing the flat plate silver halide grains should preferably be 0.5 μm to 5.0 μm, more preferably 1.0 82 m to 3.0 μm.

Also, the amount of the flat plate silver halide grains coated (on one side) may preferably be 0.5 $g/m^2$ to 6 $g/m^2$, more preferably 1 $g/m^2$ to 5 $g/m^2$.

Other constitutions of the layer containing the flat plate silver halide grains, for example, binder, film hardening agent, antifoggant, stabilizer for silver halide, surfactant, spectral sensitizing dyestuff, dye, UV-absorber, etc. are not particularly limited, but reference may be made to the description in, for example, Research Disclosure, Vol. 176, pp. 22–28 (December, 1978).

Next, description is made about the silver halide emulsion layer (hereinafter written as the upper silver halide emulsion layer) existing on the outside (surface side) of the layer containing the above flat plate silver halide grains.

The silver halide grains to be used in the upper silver halide emulsion may preferably be high sensitivity silver halide grains to be used for conventional direct X-ray film.

The silver halide grains should preferably be shaped in spheres or polyhedrons or mixtures thereof. Particularly, 60% or more (by weight) of the whole grains should preferably be constituted of spherical grains and/or polyhedral grains which has diameter/thickness ratio of 5 or less.

The average grain size should preferably be 0.5 μm to 3 μm, and the grains can be grown with the use of a solvent such as ammonia, thioether, thiourea, etc., if desired.

The silver halide grains should preferably be sensitized according to the gold sensitization method, the sensitization method with other metals, or the reductive sensitization method, or the sulfur sensitization method, or the sensitization method according to a combination of two or more of these methods.

Other constitutions of the upper emulsion layer are not particularly limited similarly as the layer containing flat plate silver halide grains, and reference may be made to the description in Research Disclosure Vol. 176, supra.

It is also preferable to incorporate epitaxially junctioned silver halide grains as disclosed in Japanese Provisional Patent Publications No. 103725/1978, No. 133540/1984, No. 162540/1984, etc.

The silver halide emulsion of the present invention can contain various additives conventionally used depending on the purpose. For example, there may be included stabilizers or antifoggants such as azaindenes, triazoles, tetrazoles, imidazoliums, tetrazolium salts, polyhydroxy compounds, etc.; film hardeners such as of aldehyde type, aziridine type, isoxazole type, vinyl sulfone type, acryloyl type, carbodiimide type, maleimide type, methanesulfonic acid ester type, triazine type, etc.; developing accelerators such as benzyl alcohol, polyoxyethylene type compounds, etc.; image stabilizers such as couromane type, couramane type, bisphenol type, phosphite ester type; lubricants such as wax, glycerides of higher fatty acids, higher alcohol esters of higher fatty acids, etc. Also, as surfactants, for coating aids, enhancer of penetrability of processing solutions, defoaming agents or materials for controlling various physical properties of the light-sensitive material, there may be employed various surfactants of anionic type, cationic type, nonionic type and amphoteric type. Particularly, it is preferred that these surfactants should be dissolved out into the processing solution having bleaching ability. As the antistatic agent, there may effectively be employed diacetyl cellulose, styrene-perfluoroalkyl sodium maleate copolymer and alkali salt of the reaction product of styrne-maleic acid anhydride copolymer and p-aminobenzenesulfonic acid. The matting agent may include polymethyl methacrylate, polystyrene and alkali-soluble polymers. Further, colloidal silicon oxide may also be available. As the latex to be added for improvement of film properties, there may be employed copolymers of an acrylic acid ester, a vinyl ester with other monomers having ethylenic groups. The gelatin plasticizer may be, for example, glycerine, glycolic compounds, etc., and the thickeners may be, for example, styrene-sodium maleate copolymer, alkyl vinyl ether-maleic acid copolymer, etc.

In the color light-sensitive material of the present invention, the hydrophilic colloid to be used for preparation of emulsions and other hydrophilic colloid layer coating solutions may include any of proteins such as gelatin, gelatin derivatives, graft polymers of gelatin with other polymers, albumin, casein, etc.; cellulose derivative such as hydroxyethyl celluslose, carboxymethyl cellulose, etc.; starch derivatives; synthetic hydrophilic homopolymers or copolymers such as polyvinyl alcohol, polyvinylimidazole, polyacrylamide, etc.

The support for the color light-sensitive material of the present invention may be, for example, a glass plate, a polyester film such as cellulose acetate, cellulose nitrate or polyethylene terephthalate, a polyamide film, a polycarbonate film, a polystyrene film, etc., and further it may be a conventional reflective support (e.g. baryta paper, polyethylene-coated paper, polypropylene synthetic paper, transparent support provided with a reflective layer or employing a reflective material in combination), and these supports may be selected appropriately depending on the purpose of use of the light-sensitive material.

For coating of the silver halide emulsion layers and other photographic constituent layers to be used in the present invention, there may be employed various coating methods such as dip coating, air doctor coating, curtain coating, hopper coating, etc. It is also possible to use simultaneous coating two or more layers according to the method as disclosed in U.S. Pat. Nos. 2,761,791 and 2,941,898.

For applying the silver halide emulsion layer for a light-sensitive material for color, there may be employed the method and the materials to be used for light-sensitive materials for color, for example, incorporation of cyan, magenta and yellow couplers in combination into the silver halide emulsions of the present invention controlled by color sensitization to red-sensitive, green-sensitive and blue-sensitive.

The color light-sensitive material for which the bleach-fixing solution of the present invention is applicable may be of the internal developing system containing a color forming agent in the light-sensitive material (see U.S. Pat. Nos. 2,376,679 and 2,801,171) or otherwise of the external developing system containing a color forming agent in the developer (see U.S. Pat. Nos. 2,252,718, 2,592,243 and 2,590,970). The color forming agent may be any of those generally known in the field of the art. For example, as the cyan color forming agent, there may be employed those having a naphthol or phenol structure as the basic structure and capable of forming an inodoaniline dye through coupling; as the magenta color forming agents, those having a 5-pyrazolone ring having active methylene group as the skeltal structure; and as the yellow color forming agents, those having an acylacetanilide structure such as benzoylacetanilide or pivalylacetanilide having active methylene chain, and having or not having substituent at the coupling position. Thus, as the color forming agent, either the so-called diequivalent type coupler or tetraequivalent type coupler may be applicable.

The monochromatic developer to be used for processing of the present invention may be one called as the black-and-white first developer to be used for color light-sensitive materials or one to be used for monochromatic light-sensitive material, which can incorporate various additives to be added in monochromatic developers in general.

Typical additives may include developing agents such as 1-phenyl-3-pyrazolidone, Metol and hydroquinone; preservatives such as sulfites; accelerators comprising alkalis such as sodium hydroxide, sodium carbonate, potassium carbonate, etc.; inorganic or organic inhibitors such as potassium bromide or 2- methylbenzimidazole, methylbenzthiazole, etc.; hard water softeners such as polyphosphoric acid salt; surface excessive developing preventives comprising minute amount of iodide or thiol compound, and so on.

The aromatic primary amine color developing agent to be used in the color developer to be used prior to processing with the bleach-fixing solution of the present invention may include various compounds widely employed in various color photographic processes. These developing agents include aminophenol type and p-phenylenediamine type derivatives. These compounds are employed rather in salt form such as hydrochloride or sulfate for the purpose of stability than in free form. these compounds should preferably be employed at concentrations of about 0.1 g to about 30 g per liter of the color developer, more preferably about 1 g to about 15 g per liter.

As the aminophenol type developer, there may be included, for example, o-aminophenol, p-aminophenol, 5 -amino-2-hydroxytoluene, 2-amino-3-hydroxytoluene, 2-hydroxy-3-amino-1,4-dimethylbenzene and the like.

Particularly useful aromatic primary amine color developing agents are N,N-dialkyl-p-phenylenediamine type compounds, of which the alkyl groups and the phenyl group may either be substituted or not. Among them, particularly useful compounds are N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-$\beta$-methanesulfonamidoethyl-3-methyl-4-aminoaniline sulfate, N-ethyl-N-$\beta$-hydroxyethylaminoaniline sulfate, 4-amino-3-methyl-N,N-diethylaniline sulfate, 4-amino-N-(2-methoxyethyl)-N-ethyl-3-methylaniline-p-toluenesulfonate and the like.

In the present invention, particularly useful color developing agents are p-phenylenediamine color developing agents having at least one water soluble group (hydrophilic group) on the amino group, and typical examples are set forth below, but the present invention is not limited thereto.

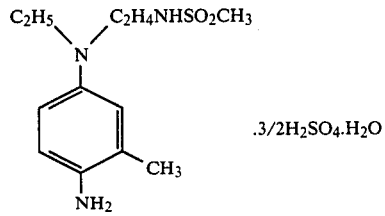

(1)

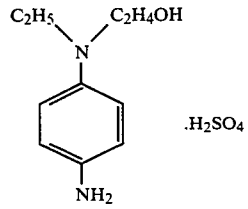

(2)

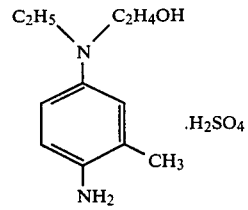

(3)

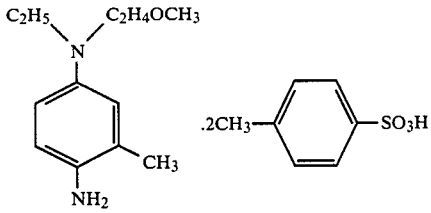

(4)

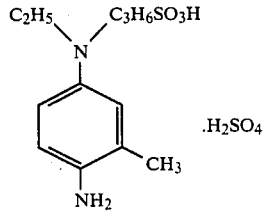

(5)

-continued (6)

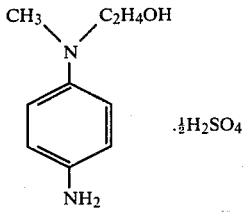

(7)

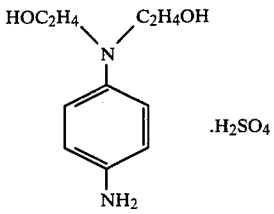

(8)

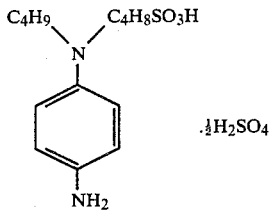

(9)

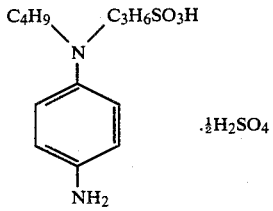

(10)

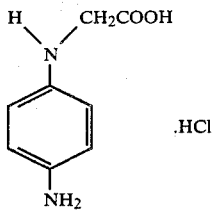

(11)

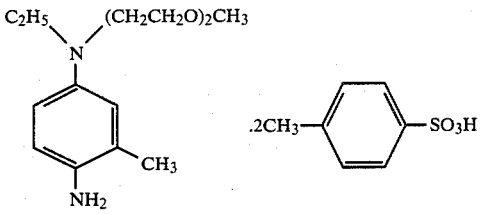

(12)

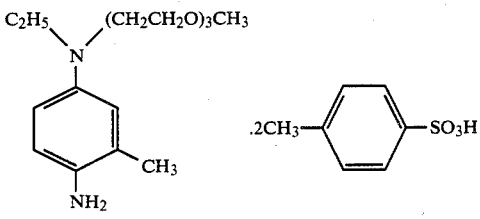

-continued (13)

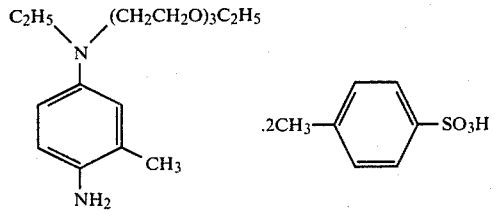

(14)

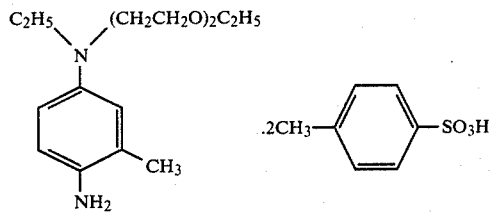

Particularly useful color developing agents in the present invention are compounds having respective groups of $-(CH_2)_nCH_2OH$, $-(CH_2)_mNHSO_2(CH_2)_nCH_3$, $-(CH_2)_mO(CH_2)_nCH_3$ as the substituent on the amino groups, and examples of these compounds may include (1), (2), (3), (4), (6) and (7) as mentioned above. In the above formulae, m and n are integers of 0 to 6, preferably 0 to 5.

The above p-phenylenediamine type color developing agent should preferably be incorporated into the bleach-fixing solution of the present invention.

The alkaline color developer to be used before processing with the bleach-fixing solution of the present invention can further contain various components conventionally added in color developers, in addition to the above aromatic primary amine type color developer, for example, alkali agents such as sodium hydroxide, sodium carbonate, potassium carbonate, etc., water softeners and thickeners such as alkali metal sulfites, alkali metal bisulfites, alkali metal thiocyanates, alkali metal halides, benzyl alcohol, diethylenetriaminepentaacetic acid, 1-hydroxyethylidene-1,1-diphosphonic acid, etc., as desired. The pH of the color developer is usually 7 or higher, most generally about 10 to about 13.

The bleach-fixing solution according to the present invention is applicable for color light-sensitive materials employing the emulsion of the present invention such as color paper, color negative film, color positive film, color reversal film for slide, color reversal film for movie, color reversal film for TV, reversal color paper, etc., and it is most suitable for processing of a high sensitivity color light-sensitive material containing silver iodide with the total amount of silver coated of 20 $mg/dm^2$ or more and 80 $mg/dm^2$ or less.

The present invention is described in more detail by referring to the following examples, by which the embodiments of the present invention are not limited.

EXAMPLE 1

PREPARATION OF EMULSIONS

Five kinds of mono-dispersed emulsions comprising silver iodobromide containing 6.0 mole % of silver iodide were prepared, and each emulsion applied with gold sensitization and sulfur sensitization. After completion of ripening, 4-hydroxy-6-methyl-1,3,3*a*, 7-tetrazaindene was added to each emulsion.

Emulsion A: core-shell type silver iodobromide emulsion with an average grain size of 1.82 μm (shell is silver iodobromide with a thickness of 0.01 μm);

Emulsion B: core-shell type silver iodobromide emulsion with an average grain size of 1.2 μm (shell is silver iodobromide with a thickness of 0.05 μm);

Emulsion C: core-shell type silver iodobromide emulsion with an average grain size of 1.2 μm (shell is silver iodobromide with a thickness of 0.5 μm);

Emulsion D: core-shell type silver iodobromide emulsion with an average grain size of 2.6 μm (grain size is 10-fold of the thickness);

Emulsion E: spherical silver iodobromide emulsion with an average grain size of 1.2 μm.

The emulsions A–C were prepared by referring to the method disclosed in Japanese Provisional Patent Publications No. 48521/1979 and No. 49938/1983 by controlling pAg and pH; the emulsion D by the method disclosed in Japanese Provisional Patent Publications No. 113934/1983 and No. 99433/1984; and the emulsion E by the method disclosed in Japanese Provisional Patent Publication No. 49938/1983.

Preparation of Light-Sensitive Materials

The color light-sensitive materials were prepared by adding the following compounds to the above emulsions.

Optical sensitization was effected by use of red-sensitive sensitizing dyes, namely, 285 mg/1 mole AgX of anhydro-3,3'-di-(3-sulfopropyl)-5,5'-dichloro-9-ethylthiacarbocyaninehydroxide (dye p-1), 38.5 mg/1 mole AgX of anhydro-3,3'-di-(3-sulfopropyl)-4,5,4',5'-dibenzothiacarbocyaninehydroxide (dye p-2) and 116 mg/1 mole AgX of anhydro-1,3'-diethyl-3-(3-sulfopropyl)-5-trichloromethyl-4',5'-benzobenzimidazolothiacarbocyaninehydroxide (dye p-3). To this photographic emulsion was added a dispersion of a solution of a cyan coupler of 2-(α,α,β,β,γ,γ,δ,δ-octafluorohexanamido)-5-[2-(2,4-di-t-amylphenoxy)-hexanamido]phenol in tricresyl phosphate prepared by protect dispersion in a conventional manner to a content of 0.3 mole of the coupler per 1 mole of AgX. Further, 4-hydroxy-6-methyl-1,3,3a,7-tetrazaindene as the stabilizer, poly-N-vinylpyrrolidone as the physical developing inhibitor and 1-phenyl-5-mercaptotetrazole as the antifoggant were added, and the above emulsion was applied in layers on the polyethyleneterephthalate film applied with black colloid silver. The first layer was made to have an average thickness of 4.2 μm and the intermediate layer to have a thickness of 2 μm, each being applied in several layers. Coatings with a thickness of 37.2 μm in six layers and with a thickness of 18.6 μm in three layers were prepared. The silver quantities were 96 mg/100 cm² and 46 mg/100 cm², respectively. This film swelling speed of the binder $T_{\frac{1}{2}}$ was within the range from 9 seconds to 14 seconds.

Developing Processing

The above color light-sensitive materials were exposed in a conventional manner and subjected to the following developing processing.

After carrying out color developing for 3 minutes to 15 seconds, bleach-fixing processing for one minute to 30 minutes, washing with water for 2 minutes and stabilizing processing for one minute, successively, the processed materials were dried.

Each processing was conducted at 37.8° C. and the respective processing solutions were prepared according to the recipes shown below.

| | |
|---|---|
| Color developing solution | |
| Potassium carbonate | 30 g |
| Sodium sulfite | 2.0 g |
| Hydroxylamine sulfate | 2.0 g |
| Potassium bromide | 1.2 g |
| Sodium hydroxide | 3.4 g |
| N—ethyl-N—β-hydroxyethyl-3-methyl-4-aminoaniline sulfate | 4.6 g |
| (made up to one liter with addition of water and adjusted to pH 10.1 with sodium hydroxide) | |
| Bleach-fixing solution | |
| Diammonium ethylenediaminetetraacetate | 7.5 g |
| Iron (III) ammonium ethylenediaminetetraacetate | 150.0 g |
| Ammonium sulfite (50% solution) | 10.0 g |
| Ammonium thiosulfate (70% solution) | 200.0 g |
| (made up to one liter with addition of water and adjusted to pH 7.5 with ammonium hydroxide) | |

This bleach-fixing solution is called (1), to which 0.7 g/1 of the exemplary compound (1) of the bleaching accelerator was added to prepare a bleach-fixing solution (2).

| | |
|---|---|
| Stabilizing solution | |
| Formalin (35% aqueous solution) | 7.0 ml |
| 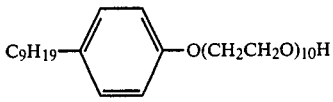 | 1.0 ml |
| (made up to one liter with water) | |

The results are shown in Table 1. Sensitivities are represented relative to the sensitivity of the sample (5) as 100. In the Table, S indicates sensitivity.

TABLE 1

| Sample No. | Emulsion | Thickness of shell (μm) | S* (relative sensitivity) | Desilverization completion time (Bleach-fixing characteristic) (min) Film thickness 37.2 μm Silver quantity 96 mg/dm² (1) no accelerator | Film thickness 37.2 μm Silver quantity 96 mg/dm² (2) with accelerator | Film thickness 18.6 μm Silver quantity 46 mg/dm² (1) no accelerator | Film thickness 18.6 μm Silver quantity 46 mg/dm² (2) with accelerator |
|---|---|---|---|---|---|---|---|
| (1) | A | 0.01 | 142 | 22 | 18 | 12 | 4 |
| (2) | B | 0.05 | 220 | 23 | 16 | 12 | 3 |
| (3) | C | 0.5 | 140 | 21 | 17 | 13 | 4 |
| (4) | D | — | 190 | 22 | 16 | 12 | 4 |
| (5) | E | — | 100 | 18 | 12 | 10 | 6 |

*Sensitivity was measured for a sample coated once.

As apparently seen from the above results, when the samples (1), (2) and (3) satisfying the preferable conditions of the present invention are used as the light-sensitive material, even by use of the bleach-fixing solution of the prior art, developing characteristic is more excellent as compared with the samples (4) and (5) not satisfying the conditions of the present invention, and also excellent in sensitizing effect. Further, the results in Table 1 suggest that there is the optimum shell thickness. However, it can also be seen that even such an excellent photographic material may be markedly poor in bleaching characteristic with the bleach-fixing solution of the prior art in any case, when the film thickness is thick and the amount of silver coated is much.

Also, in the case of a film thickness of 18.6 μm and an amount of silver coated of 46 mg/dm$^2$, the desilverization completion time is not shortened significantly unless a bleaching accelerator is contained in the bleach-fixing solution. However, to be suprising enough, it can be seen that the core-shell emulsion which is the preferred emulsion of the present invention can be processed within a particularly short desilverization completion time when a bleaching accelerator is contained therein.

EXAMPLE 2

Similarly as in the layer constitution employed for a high sensitivity light-sensitive silver halide color photographic material in this field of art, with various auxiliary layers being interposed, a halation preventive layer, a red-sensitive silver halide emulsion layer, a green-sensitive silver halide emulsion layer and a blue-sensitive silver halide emulsion layer were laminated from the side of the support, and the mono-dispersed high sensitivity emulsion layer was arranged on the outermost side of said blue-sensitive silver halide emulsion layer. That is, the samples were prepared as described below, but the samples were made with various dried film thicknesses by varying the gelatin quantity to control the film thickness so that the amount of silver coated might be constant. The amounts of silver coated were controlled to two kinds of 100 mg/dm$^2$ and 50 mg/dm$^2$.

However, the following description gives only the coating conditions, and the respective recipes were prepared by varying gelatin content for varying film thicknesses.

Layer 1 . . . A dispersion of 0.8 g of black colloid silver exhibiting high absorbance by the light at a wavelength region of 400 to 700 nm obtained by reducing silver nitrate with the use of hydroquinone as the reducing agent in 3 g of gelatin was prepared and a halation preventive layer was provided by coating.

Layer 2 . . . An intermediate layer comprising gelatin (dry film thickness 0.8 μm).

Layer 3 . . . A low sensitivity red-sensitive silver halide emulsion layer containing 1.5 g of a low sensitivity red-sensitive silver iodobromide emulsion (6 mole % of AgI), 1.9 g of gelatin and 0.4 g of tricresyl phosphate (hereinafter called TCP) containing 0.96 g of 1-hydroxy-4-(β-methoxyethylaminocarbonylmethoxy)-N-[δ-(2,4-di-t-amylphenoxy)butyl]2-naphthoamide (hereinafter called Cyan coupler (C-1)), 0.028 g of 1-hydroxy-4-[4-(1-hydroxy-8-acetamido-3,6-disulfo-2-naphthylazo)-phenoxyl]-N-[δ-(2,4-diamylphenoxy)-butyl]-2-naphthoamide disodium (hereinafter called Colored cyan coupler (CC-1)) dissolved therein.

Layer 4 . . . A high sensitivity red-sensitive silver halide emulsion layer containing 1.1 g of high sensitivity red-sensitive silver iodobromide emulsion (8 mole % of AgI), 1.6 g of gelatin and 0.15 g of TCP containing 0.41 g of Cyan coupler (C-1) and 0.026 g of Colored cyan coupler (CC-1) dissolved therein.

Layer 5 . . . An intermediate layer containing 0.04 g of dibutyl phthalate (hereinafter called DBP) containing 0.08 g of 2,5-di-t-octylhydroquinone (hereinafter called Staining preventive (HQ-1)) dissolved therein and 1.2 g of gelatin.

Layer 6 . . . A low sensitivity green-sensitive silver halide emulsion layer containing 1.6 g of a low sensitivity green-sensitive silver iodobromide emulsion (15 mole % of AgI), 1.7 g of gelatin and 0.3 g of TCP containing three kinds of couplers of 0.30 g of 1-(2,4,6-trichlorophenyl)-3-[3-(2,4-di-t-amylphenoxyacetamido)-benzeneamido]-5-pyrazolone (hereinafter called Magenta coupler (M-1)), 0.20 g of 4,4-methylenebis-11-(2,4,6-trichlorophenyl)-3-[3-(2,4-di-t-amylphenoxyacetamido)-benzeneamido]-5-pyrazolone (hereinafter called Magenta coupler (M-2)) and 0.066 g of 1-(2,4,6-trichlorophenyl)-4-(1-naphthylazo)-3-(2-chloro-5-octadecenylsuccinimidoanilino)-5-pyrazolone (hereinafter called Colored Magenta coupler (CM-1)) dissolved therein.

Layer 7 . . . A high sensitivity green-sensitive silver halide emulsion layer containing 1.5 g of a high sensitivity silver iodobromide emulsion layer (11 mole % of AgI), 1.9 g of gelatin and 0.12 g of TCP containing 0.093 g of Magenta coupler (M-1), 0.094 g of Magenta coupler (M-2) and 0.049 g of Colored magenta coupler (CM-1) dissolved therein.

Layer 8 . . . A yellow filter layer containing 0.2 g of yellow colloid silver, 0.11 g of DBP containing 0.2 g of Stain preventive (HQ-1) dissolved therein and 2.1 g of gelatin.

Layer 9 . . . A low sensitivity blue-sensitive silver halide emulsion layer containing 0.95 g of a low sensitivity blue-sensitive silver iodobromide emulsion (6 mole % of AgI), 1.9 g of gelatin and 0.93 g of DBP containing 1.84 g of α-[4-(1-benzyl-2-phenyl-3,5-dioxo-1,2,4-triazolidinyl)]-α-pivaloyl-2-chloro-5-[γ-(2,4-di-t-amylphenoxy)butaneamido]acetanilide (hereinafter called Yellow coupler (Y-1)) dissolved therein.

Layer 10 . . . A high sensitivity blue-sensitive silver halide emulsion layer containing 1.2 g of a high sensitivity blue-sensitive silver iodobromide emulsion (7 mole % of AgI), 2.0 g of gelatin and 0.23 g of DBP containing 0.46 g of Yellow coupler (Y-1) dissolved therein.

Layer 11 . . . A second protective layer comprising gelatin.

Layer 12 . . . A first protective layer containing 2.3 g of gelatin.

The dry film thicknesses of the photographic constituent layers in the finished samples were found to be 7 kinds of 35 μm, 30 μm, 27 μm, 25 μm, 22 μm, 20 μm and 18 μm. These were called Samples No. 1–7. The film thickness of the halation preventive layer and the black colloid silver content were not changed at all.

Further, as other samples, there were formed those having the same emulsions applied on transparent polyethylene terephthalate film bases without the colloid silver halation preventive layer of the lowest layer. These layers were called Samples No. 8–14 in the order of thicker film thickness. Further, by use of the emulsions with the same compositions as in Samples No. 1–14, 14 kinds of samples accelerated in film swelling speed $T_{\frac{1}{2}}$ as shown in Table 2-2 by reducing the amount of film hardeners were prepared.

The processing steps were conducted for 3 minutes to 15 seconds for color developing, one minute to 30 minutes for bleach-fixing, 2 minutes for the first stabilizing and 30 seconds for the second stabilizing. Each processing was performed at 37.8° C., and the respective processing solutions as formulated below were employed.

| | |
|---|---|
| Color developing solution | |
| Potassium carbonate | 30 g |
| Sodium sulfite | 2.0 g |
| Hydroxylamine sulfate | 2.0 g |
| 1-Hydroxyethylidene 1-1 diphosphonic acid (60% aqueous solution) | 1.0 g |
| Potassium bromide | 1.2 g |
| Magnesium chloride | 0.6 g |
| Sodium hydroxide | 3.4 g |
| N—ethyl-N—β-hydroxyethyl-3-methyl-4-aminoaniline sulfate | 4.6 g |
| (made up to one liter with addition of water and adjusted to pH 10.1 with sodium hydroxide). | |
| Bleach-fixing solution | |
| Diammonium ethylenediaminetetraacetate | 7.5 g |
| Aminopolycarboxylic acid ferric complex (added according to Table 2) | |
| Ammonium sulfite (50% solution) | 10.0 g |
| Ammonium thiosulfate (70% solution) | 200.0 g |
| (made up to one liter with addition of water and adjusted to pH 7.5 with ammonium hydroxide). | |
| First stabilizing solution | |
| 1-Hydroxyethylidene 1-1 diphosphonic acid | 3.0 g |
| 5-Chloro-2-methyl-4-isothiazolin-3-one | 1.0 g |
| Ethylene glycol | 1.0 g |
| (made up to one liter with addition of water and adjusted to pH 7.1 with potassium hydroxide). | |
| Second stabilizing solution | |
| Formalin (35% aqueous solution) | 7.0 ml |
| 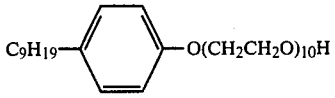 | 1.0 ml |
| (made up to one liter with addition of water) | |

As the aminocarboxylic acid in the bleach-fixing solution, ferric ethylenediaminetetraacetate complex was used for processing. The bleaching accelerator was added in an amount of 0.7 g of the exemplary compound (1) per liter. The bleach-fixing completion time was measured to obtain the results shown in Table 2.

TABLE 2

| | | | Film swelling speed ($T_{\frac{1}{2}}$) = 35 sec. Bleach-fixing solution (0.3 mole ferric ammonium ethylenediaminetetraacetate) | | | |
|---|---|---|---|---|---|---|
| Sample No. | Film thickness (μm) | Presence of colloid silver halation preventive layer | no accelarator Silver quantity | containing the exemplary compound (1) as the accelerator 100 mg/dm² | no accelerator Silver quantity | containing the exemplary compound (1) as the accelerator 50 mg/dm² |
| 1 | 35 | Do | 30 min or longer | 28 min | 30 min or longer | 24 min |
| 2 | 30 | Do | 30 min or longer | 28 min | 30 min or longer | 21 min |
| 3 | 27 | Do | 30 min or longer | 24 min | 28 min | 21 min |
| 4 | 25 | Do | 30 min or longer | 21 min | 22 min | 6 min |
| 5 | 22 | Do | 30 min or longer | 21 min | 21 min | 6 min |
| 6 | 20 | Do | 28 min | 18 min | 20 min | 5 min |
| 7 | 18 | Do | 26 min | 17 min | 20 min | 5 min |
| 8 | 35 | None | 19 min | 12 min | 7 min | 6 min |
| 9 | 30 | None | 18 min | 12 min | 7 min | 6 min |
| 10 | 27 | None | 15 min | 11 min | 7 min | 6 min |
| 11 | 25 | None | 15 min | 10 min | 5 min | 5 min |
| 12 | 22 | None | 14 min | 10 min | 5 min | 5 min |
| 13 | 20 | None | 13 min | 9 min | 5 min | 5 min |
| 14 | 18 | None | 13 min | 9 min | 5 min | 5 min |

| | | | Film swelling speed ($T_{\frac{1}{2}}$) = sec. Bleached fixing solution (0.3 mole ferric ammonium ethylenediaminetetraacetate | | | |
|---|---|---|---|---|---|---|
| Sample No. | Film thickness (μm) | Presence of colloid silver halation preventive layer | no accelerator Silver quantity | containing the exemplary compound (1) as the accelerator 100 mg/dm² | no accelerator ZSilver quantity | containing the exemplary compound (1) as the accelerator 50 mg/dm² |
| 15 | 35 | Do | 30 min or longer | 22 min | 22 min | 18 min |
| 16 | 30 | Do | 30 min or longer | 20 min | 18 min | 16 min |
| 17 | 27 | Do | 26 min | 18 min | 14 min | 5 min |
| 18 | 25 | Do | 22 min | 16 min | 8 min- | 5 min |
| 19 | 22 | Do | 18 min | 15 min | 6 min | 5 min |
| 20 | 20 | Do | 16 min | 14 min | 4 min | 5 min |
| 21 | 18 | Do | 14 min | 12 min | 4 min | 4 min |
| 22 | 35 | None | 20 min | 14 min | 7 min | 6 min |
| 23 | 30 | None | 18 min | 12 min | 6 min | 6 min |
| 24 | 27 | None | 16 min | 12 min | 6 min | 5 min |
| 25 | 25 | None | 12 min | 10 min | 5 min | 4 min |
| 26 | 22 | None | 12 min | 8 min | 4 min | 4 min |

TABLE 2-continued

| | | | | | | |
|---|---|---|---|---|---|---|
| 27 | 20 | None | 11 min | 8 min | 4 min | 4 min |
| 28 | 18 | None | 10 min | 8 min | 4 min | |

As apparently seen from the above results in Tables 2-1 and 2-2, in light-sensitive multi-layer silver halide color photographic materials having black colloid silver halation preventive layer, when the film thickness of photographic constituent layer (gelatin film thickness) is large, the bleach-fixing completion time is markedly long, which, however, will abruptly be lowered as the thickness of the photographic constituent layer is made thinner, the change being the greatest at around 25 μm. Also, as to the effect of the bleaching accelerator, it has little effect when the film thickness of the photographic constituent layer (gelatin film thickness) is large, but a markedly great effect can be appreciated to be exhibited in the case of a photographic constituent layer (gelatin film thickness) which has been made thin. It can also be understood that the silver quantity can give no great bleaching accelerating effect, irrespectively of the film thickness, in the case of samples coated with greater quantity outside the scope of the present invention.

On the other hand, in the light-sensitive silver halide color photographic materials having no black colloid silver halation preventive layer, it can be seen that the film thickness of the photographic constituent layer (gelatin film thickness) has little influence and the bleach-fixing completion time is very short. However, no such material having no halation preventive layer can be hardly practically applied, because it is worsened in sharpness as a high sensitivity photographic material such as a high sensitivity light-sensitive silver halide color photographic material for photographing.

When the bleaching accelerators (9) and (12) were investigated, the same results as above could be obtained.

Particularly, when the film swelling speed $T_{\frac{1}{2}}$ is 10 seconds, as compared with the case of the speed of 35 seconds, the bleach-fixing completion time is sufficiently short even in absence of a bleaching accelerator, thus showing that the present invention can be accomplished for the first time by use of a combination of the optimum silver quantity, film thickness and film swelling speed.

EXAMPLE 3

According to the same procedure as in Example 2, samples were prepared by varying the film thicknesses as 36 μm and 19 μm, and varying the silver quantity coated as 120 mg/dm², 100 mg/dm², 70 mg/dm², 50 mg/dm², 40 mg/dm² and 30 mg/dm², and processed by use of the bleach-fixing solution of Example 2 (aminopolycarboxylic acid shown in Table 3). The bleach-fixing completion time was measured to obtain the results shown in Table 3. In these samples, the amount of film hardening agent was varied to change the film swelling speed $T_{\frac{1}{2}}$.

TABLE 3

| Film thickness (μm) | Silver quantity (mg/dm²) | Bleach-fixing solution (0.26 mole diethylenetriamine ferric complex) $T_{\frac{1}{2}}$ 35 sec. no accelerator | $T_{\frac{1}{2}}$ 35 sec. with accelerator | $T_{\frac{1}{2}}$ 8 sec. no accelerator | $T_{\frac{1}{2}}$ 8 sec. with accelerator |
|---|---|---|---|---|---|
| 36 | 120 | 30 min or longer | 28 min | 30 min or longer | 24 min |
| 36 | 100 | 30 min or longer | 26 min | 30 min or longer | 20 min |
| 36 | 70 | 30 min or longer | 24 min | 26 min | 18 min |
| 36 | 50 | 30 min or longer | 24 min | 20 min | 16 min |
| 36 | 40 | 30 min or longer | 21 min | 15 min | 14 min |
| 36 | 30 | 30 min or longer | 21 min | 16 min | 10 min |
| 19 | 120 | 30 min or longer | 21 min | 18 min | 12 min |
| 19 | 100 | 28 min | 18 min | 14 min | 10 min |
| 19 | 70 | 28 min | 8 min | 8 min | 6 min |
| 19 | 50 | 20 min | 5 min | 6 min | 4 min |
| 19 | 40 | 14 min | 5 min | 6 min | 4 min |
| 19 | 30 | 12 min | 4 min | 5 min | 4 min |

As can also be seen from Table 3, no sufficient bleaching accelerating effect can be obtained in any case of the film thickness, silver quantity and film swelling speed $T_{\frac{1}{2}}$ outside the scope of the present invention, but a remarkable bleaching accelerating effect can be obtained when the film thickness, the silver quantity and the film swelling speed $T_{\frac{1}{2}}$ all have the values not higher than those as specified in the present invention.

EXAMPLE 4

Following the procedure of Example 3, samples (film thickness 19 μm) were prepared by varying the silver quantity coated and the film swelling speed $T_{\frac{1}{2}}$ as shown in Table 4, and these samples were processed as described above. As the bleaching solution, 0.20 mole of the organic acid ferric complex as shown in Table 4 was employed, and 0.7 g/l of the bleaching accelerator as shown in Table 4 was added. The bleach-fixing completion time under these conditions was measured to obtain the results as shown in Table 4.

TABLE 4

| Ferric aminopolycarboxylate complex | Coated silver quantity (mg/dm²) | Film swelling time ($T_{\frac{1}{2}}$ = 35 sec.) Exemplary compound of accelerator (3) | (1) | (9) | (8) | Film swelling time ($T_{\frac{1}{2}}$ = 8 sec.) Exemplary compound of accelerator (3) | (1) | (9) | (8) |
|---|---|---|---|---|---|---|---|---|---|
| Ferric | 120 | 22 min | 22 min | 21 min | 22 min | 14 min | 13 min | 14 min | 16 min |
| triethylene- | 100 | 20 min | 21 min | 22 min | 20 min | 13 min | 12 min | 13 min | 14 min |
| tetramine- | 90 | 19 min | 19 min | 20 min | 20 min | 11 min | 10 min | 12 min | 13 min |
| hexaacetate | 75 | 16 min | 15 min | 14 min | 12 min | 8 min | 8 min | 7 min | 8 min |
| complex | 50 | 13 min | 14 min | 12 min | 11 min | 6 min | 6 min | 6 min | 6 min |
| (494.45) | 40 | 12 min | 12 min | 10 min | 10 min | 5 min | 4 min | 5 min | 6 min |
| 0.3 mole | 30 | 10 min | 11 min | 10 min | 10 min | 4 min | 4 min | 5 min | 5 min |
| Ferric | 120 | 18 min | 18 min | 21 min | 21 min | 13 min | 12 min | 16 min | 17 min |
| diethylene- | 100 | 16 min | 16 min | 20 min | 20 min | 11 min | 10 min | 14 min | 14 min |

TABLE 4-continued

| Ferric aminopoly-carboxylate complex | Coated silver quantity (mg/dm²) | Film swelling time ($T_{\frac{1}{2}}$ = 35 sec.) Exemplary compound of accelerator (3) | (1) | (9) | (8) | Film swelling time ($T_{\frac{1}{2}}$ = 8 sec.) Exemplary compound of accelerator (3) | (1) | (9) | (8) |
|---|---|---|---|---|---|---|---|---|---|
| triamine-pentaacetate complex (393.27) 0.3 mole | 90 | 14 min | 14 min | 20 min | 19 min | 10 min | 10 min | 12 min | 12 min |
| | 75 | 10 min | 11 min | 12 min | 12 min | 7 min | 6 min | 6 min | 7 min |
| | 50 | 9 min | 9 min | 11 min | 11 min | 5 min | 4 min | 6 min | 6 min |
| | 40 | 9 min | 8 min | 10 min | 10 min | 4 min | 4 min | 5 min | 5 min |
| | 30 | 8 min | 8 min | 8 min | 8 min | 4 min | 4 min | 5 min | 5 min |
| Ferric 1,2-diamino-propane-tetraacetate complex (306.27) 0.31 mole | 120 | 26 min | 24 min | 26 min | 26 min | 17 min | 16 min | 16 min | 15 min |
| | 100 | 25 min | 22 min | 22 min | 22 min | 15 min | 14 min | 15 min | 14 min |
| | 90 | 22 min | 19 min | 20 min | 18 min | 13 min | 12 min | 13 min | 13 min |
| | 75 | 10 min | 11 min | 14 min | 12 min | 8 min | 8 min | 9 min | 8 min |
| | 50 | 7 min | 7 min | 8 min | 8 min | 6 min | 6 min | 7 min | 7 min |
| | 40 | 7 min | 7 min | 6 min | 8 min | 5 min | 5 min | 5 min | 6 min |
| | 30 | 6 min | 6 min | 6 min | 6 min | 5 min | 4 min | 5 min | 6 min |
| Ferric ethylene-diamine-tetraacetate complex (292.25) 0.3 mole | 120 | 24 min | 22 min | 27 min | 27 min | 16 min | 14 min | 15 min | 14 min |
| | 100 | 22 min | 20 min | 23 min | 24 min | 14 min | 12 min | 14 min | 12 min |
| | 90 | 18 min | 16 min | 17 min | 18 min | 12 min | 10 min | 10 min | 11 min |
| | 75 | 11 min | 11 min | 10 min | 14 min | 10 min | 6 min | 7 min | 7 min |
| | 50 | 5 min | 4 min | 5 min | 5 min | 6 min | 4 min | 5 min | 6 min |
| | 40 | 5 min | 3 min | 4 min | 5 min | 4 min | 4 min | 5 min | 4 min |
| | 30 | 4 min | 3 min | 4 min | 4 min | 4 min | 4 min | 4 min | 4 min |
| Ferric hydroxy-ethylimino acetate complex (177.16) 0.32 mole | 120 | 30 min or longer | 30 min or longer | 30 min or longer | 30 min or longer | 16 min | 15 min | 17 min | 16 min |
| | 100 | 27 min | 27 min | 30 min or longer | 30 min or longer | 13 min | 14 min | 15 min | 15 min |
| | 90 | 22 min | 23 min | 23 min | 24 min | 11 min | 12 min | 12 min | 13 min |
| | 75 | 18 min | 18 min | 12 min | 12 min | 8 min | 10 min | 8 min | 9 min |
| | 50 | 8 min | 7 min | 6 min | 6 min | 5 min | 6 min | 5 min | 6 min |
| | 40 | 6 min | 6 min | 5 min | 5 min | 5 min | 4 min | 5 min | 6 min |
| | 30 | 5 min | 5 min | 4 min | 4 min | 5 min | 4 min | 5 min | 5 min |
| Ferric methyl imino-acetate complex (147.13) 0.3 mol | 120 | 30 min or longer | 30 min or longer | 30 min or longer | 30 min or longer | 18 min | 16 min | 15 min | 16 min |
| | 100 | 28 min | 26 min | 30 min or longer | 30 min or longer | 16 min | 15 min | 14 min | 13 min |
| | 90 | 22 min | 22 min | 24 min | 26 min | 11 min | 10 min | 10 min | 12 min |
| | 75 | 19 min | 17 min | 12 min | 10 min | 8 min | 8 min | 7 min | |
| | 50 | 6 min | 6 min | 5 min | 4 min | 6 min | 6 min | 6 min | |
| | 40 | 5 min | 5 min | 4 min | 5 min | 4 min | 5 min | 4 min | |
| | 30 | 5 min | 5 min | 4 min | 4 min | 5 min | 4 min | 5 min | 4 min |

From the results in Table 4, it can be seen that, if the film thickness is 19 μm, desirable bleach-fixing acceleration can be exhibited at numerical values of silver quantity coated and film swelling speed not higher than those specified in the present invention. Particularly, when the film swelling speed $T_{\frac{1}{2}}$ is great, an organic acid ferric complex with lower molecular weight had a markedly greater bleaching accelerating effect due to lowering in silver quantity than an organic acid ferric complex with higher molecular weight. However, when the film swelling speed $T_{\frac{1}{2}}$ was small, no such result was obtained, but good desilverization speed is exhibited at the optimum silver quantity in either one of the high molecular weight organic acid ferric complex or the low molecular weight organic acid ferric complex.

EXAMPLE 5

According to the same process as in Example 2, with various auxiliary layers being interposed, a halation preventive layer, a low sensitivity red-sensitive silver halide emulsion layer and a high sensitivity red-sensitive silver halide emulsion were provided by coating. For the purpose of controlling the film thickness, the red-sensitive silver halide emulsion layer was provided by repeated coating. The film swelling speed $T_{\frac{1}{2}}$ was adjusted to two kinds of 35 seconds and 7 seconds.

Layer 1 . . . A halation preventive layer containing black colloid silver entirely the same as in Layer 1 in Example 2.

Layer 2 . . . An intermediate layer entirely the same as Layer 2 in Example 2.

Layer 3 . . . A low sensitivity red-sensitive silver halide emulsion layer entirely the same as Layer 3 in Example 2 except for changing the silver iodide content as shown in Table 5.

Layer 4 . . . A high sensitivity red-sensitive silver halide emulsion layer entirely the same as Layer 4 in Example 2 except for changing the silver iodide content as shown in Table 5.

Layer 5 . . . An intermediate layer entirely the same as Layer 5 in Example 2.

Layer 6 . . . Layer 3 was coated again.

Layer 7 . . . Layer 4 was coated again.

Layer 8 . . . Layer 5 was coated again.

Layer 9 . . . Layer 3 was coated again.

Layer 10 . . . Layer 4 was coated again.

Layer 11 . . . Layer 5 was coated again.

Layer 12 . . . A second protective layer entirely the same as Layer 11 in Example 2.

Layer 13 . . . A first protective layer entirely the same as Layer 12 in Example 2.

The photographic constituent layer of the finished sample was found to have a dry film thickness of about 20 μm. Following Example 2, exposure and developing processing were performed. The results are shown in Table 5.

TABLE 5

| Film swelling Speed $T_{\frac{1}{2}}$ | AgI content (average mole %) | Bleach-fixing solution EDTA-Fe(*1) no accelerator | EDTA-Fe(*1) with accelerator | DTPA-Fe(*2) no accelerator | DTPA-Fe(*2) with accelerator | HIDA-Fe(*3) no accelerator | HIDA-Fe(*3) with accelerator |
|---|---|---|---|---|---|---|---|
| 35 sec. | 0.1 | 11 min | 8 min | 8 min | 4 min | 12 min | 6 min |
| | 0.3 | 13 min | 12 min | 11 min | 4 min | 18 min | 6 min |
| | 0.5 | 21 min | 16 min | 18 min | 8 min | 12 min | 10 min |
| | 1.0 | 30 min or longer | 21 min | 26 min | 12 min | 30 min or longer | 14 min |
| | 3.0 | 30 min or longer | 24 min | 30 min or longer | 12 min | 30 min or longer | 14 min |
| | 5.0 | 30 min or longer | 26 min | 30 min or longer | 14 min | 30 min or longer | 16 min |
| | 8.0 | 30 min or longer | 28 min | 30 min or longer | 12 min | 30 min or longer | 18 min |
| | 12.0 | 30 min or longer | 30 min or longer | 30 min or longer | 22 min | 30 min or longer | 30 min or longer |
| | 20.0 | 30 min or longer | 30 min or longer | 30 min or longer | 30 min or longer | 30 min or longer | 30 min or longer |
| 7 sec | 0.1 | 9 min | 5 min | 7 min | 4 min | 8 min | 4 min |
| | 0.3 | 8 min | 6 min | 8 min | 4 min | 8 min | 4 min |
| | 0.5 | 10 min | 5 min | 8 min | 5 min | 9 min | 4 min |
| | 1.0 | 12 min | 4 min | 9 min | 5 min | 9 min | 5 min |
| | 3.0 | 12 min | 4 min | 9 min | 6 min | 9 min | 7 min |
| | 5.0 | 14 min | 6 min | 10 min | 6 min | 10 min | 7 min |
| | 8.0 | 14 min | 5 min | 10 min | 5 min | 11 min | 6 min |
| | 12.0 | 14 min | 5 min | 11 min | 6 min | 12 min | 8 min |
| | 20.0 | 14 min | 5 min | 12 min | 6 min | 14 min | 6 min |

(*1)EDTA-Fe: Ferric ethylenediaminetetraacetate complex
(*2)DTPA-Fe: Ferric diethylenetriaminepentaacetate complex
(*3)HIDA-Fe: Ferric hydroxyethyliminodiacetate complex As can be seen also from the results in Table 5, when the silver iodide content is low, desilverization speed is rapid irrespective of the film swelling speed $T_{\frac{1}{2}}$ or presence of a bleaching accelerator. However, as the content of silver iodide becomes greater, the bleaching speed will become markedly rapid when the film swelling speed $T_{\frac{1}{2}}$ is great, but at a level of the film swelling speed $T_{\frac{1}{2}}$ not higher than the value of the present invention, it can be appreciated that there is substantially no retardation in bleaching speed even if the silver iodide content may become 0.5 mole % or more, which is preferable with respect to photographic characteristics, particularly sensitivity or sharpness, or even 1 mole % or higher.

EXAMPLE 6

According to the same procedure as in Example 5, a sample with a silver iodide content of 8 mole %, a film swelling speed $T_{\frac{1}{2}}$ of 8 seconds and an emulsion film thickness of 19 μm was prepared.

The bleach-fixing solution employed contained 150 g of ferric ammonium diethylenetriaminepentaacetate of *2 in Example 5 per one liter and prepared based on Example 2. Exposure and developing processing were conducted similarly as in Example 5. In the bleach-fixing solution, the following bleaching accelerators of the present invention were added in various amounts. The desilverization completion time was measured to obtain the results shown in Table 6.

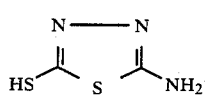

(1)

-continued

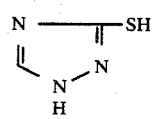

(2)

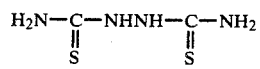

(3)

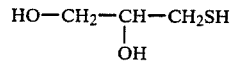

(4)

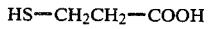

(5)

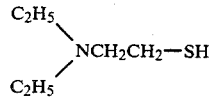

(6)

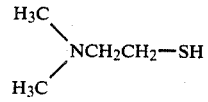

(7)

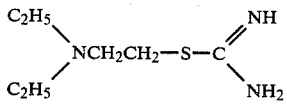

(8)

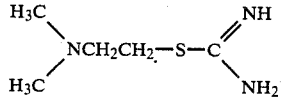

(9)

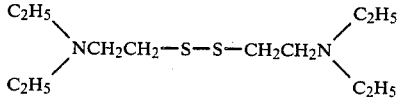

(10)

-continued
(11)
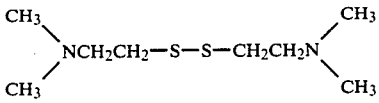
(12)
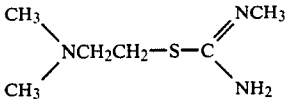
(13)
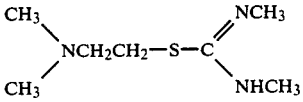
(14)
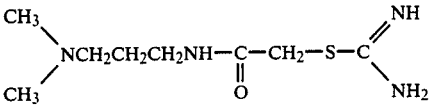
(15)
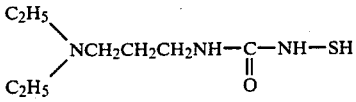
(16)
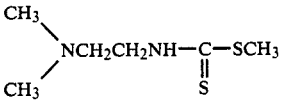
(17)
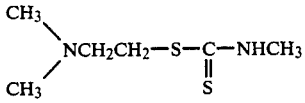
(18)
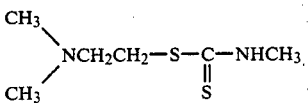
(19)
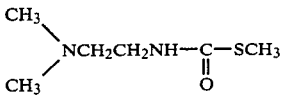
(20)
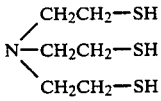
(21)
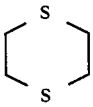
(22)
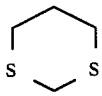
(23)
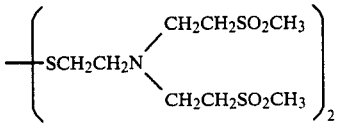
-continued
(24)
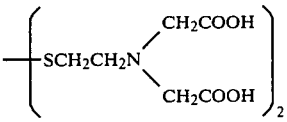
(25)
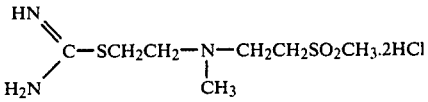
(26)
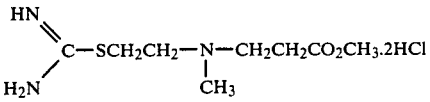
(27)
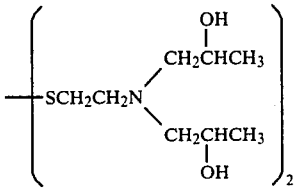
(28)
$HSCH_2CH_2NHCH_2CH_2OH$
(29)
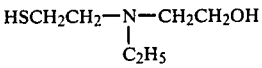
(30)
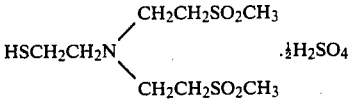
(31)
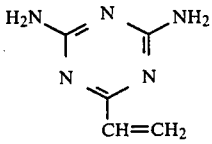
TABLE 6
| Accerelator added (Exemplary No.) | Desilverization completion time (min.) Amount of accelerator added (g/l) | | | | |
|---|---|---|---|---|---|
| | 0 | 1 | 3 | 5 | 10 |
| 1 | 12 | 5 | 6 | 6 | 7 |
| 2 | 12 | 5 | 6 | 6 | 8 |
| 3 | 12 | 5 | 5 | 7 | 8 |
| 4 | 12 | 7 | 7 | 6 | 8 |
| 5 | 12 | 6 | 5 | 7 | 7 |
| 6 | 12 | 7 | 6 | 7 | 8 |
| 7 | 12 | 7 | 6 | 7 | 8 |
| 8 | 12 | 8 | 7 | 6 | 7 |
| 9 | 12 | 8 | 7 | 6 | 7 |
| 10 | 12 | 7 | 7 | 5 | 7 |
| 11 | 12 | 7 | 7 | 5 | 7 |
| 12 | 12 | 6 | 6 | 5 | 7 |
| 13 | 12 | 8 | 7 | 6 | 8 |
| 14 | 12 | 8 | 6 | 7 | 8 |
| 15 | 12 | 7 | 6 | 7 | 8 |
| 16 | 12 | 5 | 5 | 6 | 7 |
| 17 | 12 | 6 | 7 | 7 | 8 |
| 18 | 12 | 7 | 6 | 6 | 7 |
| 19 | 12 | 5 | 5 | 6 | 7 |
| 20 | 12 | 5 | 5 | 5 | 6 |
| 21 | 12 | 5 | 6 | 6 | 7 |
| 22 | 12 | 7 | 6 | 6 | 7 |
| 23 | 12 | 6 | 6 | 7 | 7 |
| 24 | 12 | 6 | 5 | 7 | 7 |
| 25 | 12 | 5 | 6 | 6 | 7 |
| 26 | 12 | 6 | 6 | 5 | 7 |
| 27 | 12 | 6 | 5 | 7 | 7 |
| 28 | 12 | 5 | 6 | 7 | 7 |

TABLE 6-continued

| Accerelator added (Exemplary No.) | Desilverization completion time (min.) Amount of accelerator added (g/l) | | | | |
|---|---|---|---|---|---|
| | 0 | 1 | 3 | 5 | 10 |
| 29 | 12 | 6 | 6 | 8 | 8 |
| 30 | 12 | 7 | 6 | 6 | 7 |
| 31 | 12 | 5 | 5 | 5 | 6 |

As can be seen also from the results in Table 6, in samples having the film swelling speed $T_{\frac{1}{2}}$, film thickness and silver quantity coated within the range of the present invention, all of exemplary bleaching accelerators exhibit favorable bleaching accelerating effects.

Further, as separate experiments, the same experiments were conducted for two kinds of bleach-fixing solutions in which 160 g/liter of ferric ammonium ethylenediaminetetraacetate and 200 g/liter of ferric ammonium hydroxyethyliminodiacetate were employed as the bleaching agent in the bleach-fixing solution, respectively, and the desilverization completion time was measured. As the result, substantially the same good results could be obtained as in the case of ferric ammonium diethylenetriaminepentaacetate.

What is claimed is:

1. A color image forming method, which comprises subjecting a light-sensitive silver halide color photographic material having a photographic constituent layer comprising blue-sensitive, green-sensitive and red-sensitive silver halide emulsion layers and a black colloid silver halation preventive layer on a support and having a total thickness of the photographic constituent layer which is effective for photographic performance of 25 μm or less to imagewise exposure, then carrying out color developing processing of the exposed material in the presence of a dye forming complex and then carrying out bleach-fixing processing of the developed image with a bleach-fixing solution containing at least one organic acid ferric complex.

2. A color image forming method according to claim 1, wherein the silver halide emulsion layers contain silver halide grains containing 0.1 mole % or more of silver iodide in at least one layer thereof.

3. A color image forming method according to claim 1, wherein the organic acid ferric complex is one containing a free acid with a molecular weight of 280 or more as constituent of said complex.

4. A color image forming method according to claim 3, wherein the organic acid ferric complex is one containing a free acid with a molecular weight of 300 or more as constituent of said complex.

5. A color image forming method according to claim 1, further having the step of processing the bleach-fixing solution with a pre-processing solution having fixing ability immediately before processing with the bleach-fixing solution.

6. A color image forming method according to claim 1, wherein the bleach-fixing solution is provided in at least two tanks according to a cocurrent system, the former stage tank being supplemented with at least a fixing agent and the latter stage tank being supplemented with a bleaching agent, respectively.

7. A color image forming method according to claim 1, wherein the light-sensitive silver halide photographic material has a silver halide emulsion layer of which the binder film swelling speed $T_{\frac{1}{2}}$ is 25 sec. or less.

8. A color image forming method according to claim 7, wherein the bleach-fixing solution and/or the pre-processing solution contains a compound selected from those of the formulae (I)–(VII) shown below:

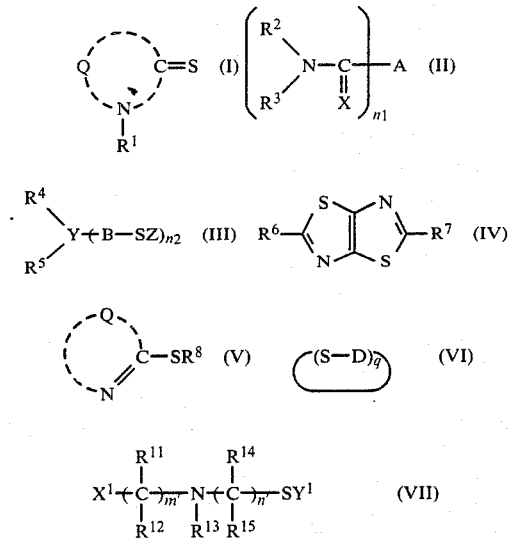

wherein Q represents a group of atoms necessary for forming a hetero ring containing 1 or more N atom (including those having at least one 5- to 6-membered unsaturated ring fused thereto); A represents a group of the formulae:

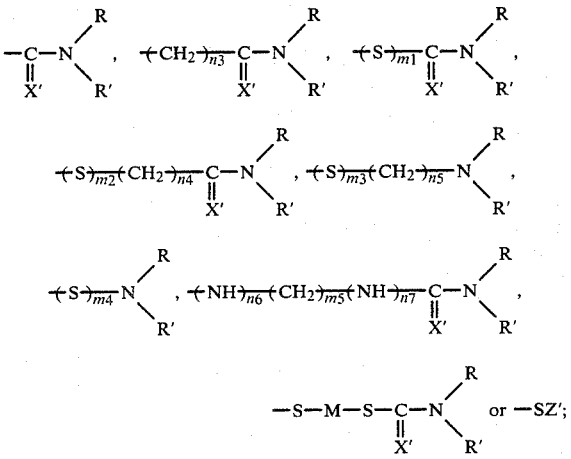

or a hetero ring residue with $n_1$ valence including those having at least one 5- to 6-membered unsaturated ring fused thereto; B represents an alkylene group having 1 to 6 carbon atoms; M represents a divalent metal atom; X and X' represent =S, =O or =NR''; R'' represents a hydrogen atom, an alkyl group having 1 to 6 carbon atoms, a cycloalkyl group, an aryl group, a hetero ring residue including those having at least one 5- to 6-membered unsaturated ring fused thereto or an amino group; Y represents

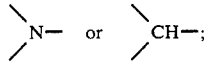

Z represents a hydrogen atom, an alkali metal atom, an ammonium group, an amino group, a nitrogen containing hetero ring residue or

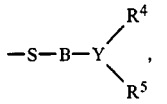

Z′ represents Z or an alkyl group; $R^1$ represents a hydrogen atom, an alkyl group having 1 to 6 carbon atoms, a cycloalkyl group, an aryl group, a hetero ring residue including those having at least one 5- to 6-membered unsaturated ring fused thereto or an amino group; each of $R^2$, $R^3$, $R^4$, $R^5$, R and R′ represents a hydrogen atom, an alkyl group having 1 to 6 carbon atoms, a hydroxy group, a carboxy group, an amino group, an acyl group having 1 to 3 carbon atoms, an aryl group, or an alkenyl group, with proviso that $R^4$ and $R^5$ may represent —B—SZ, and R and R′, $R^2$ and $R^3$, $R^4$ and $R^5$, respectively, may be mutually cyclized to form a hetero ring residue including those having at least one 5- to 6-membered unsaturated ring fused thereto; $R^6$ and $R^7$ each represent a group of the formula:

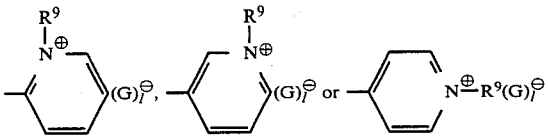

$R^9$ represents an alkyl group or $-(CH2)_{n8}SO_3^{\ominus}$ when $R^8$ is $-(CH2)_{n8}SO_3^{\ominus}$, l represents 0 or 1; $G^{\ominus}$ is an anion; $m_1$ to $m_4$ and $n_1$ to $n_8$ each represent integers of 1 to 6; $m_5$ represents an integer of 0 to 6; $R^8$ represents a hydrogen atom, an alkali metal atom, a group of the formula:

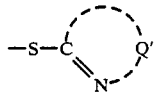

or an alkyl group; Q′ is the same as the above Q; D is a mere bonding linkage, an alkylene group having 1 to 8 carbon atoms or a vinylene group; q represents an integer of 1 to 10; the plural number of D may be either the same or different; the ring formed together with sulfur atoms may be fused further to a 5- to 6-membered unsaturated ring; $X^1$ represents —COOM′, —OH, $-SO_3M'$, $-CONH_2$, $-SO_2NH_2$, $-NH_2$, —SH, —CN, $-CO_2R^{16}$, $-SO_2R^{16}$, $-OR^{16}$, $-NR^{16}R^{17}$, $-SR^{16}$, $-SO_3R^{16}$, $-NHCOR^{16}$, $-NHSO_2R^{16}$, $-COR^{16}$ or $-OSO_2R^{16}$; $Y^1$ represents a group of the formula:

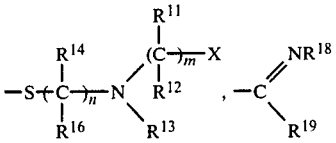

or a hydrogen atom; m′ and n′ each represent an integer of 1 to 10; $R^{11}$, $R^{12}$, $R^{14}$, $R^{15}$, $R^{17}$, and $R^{18}$ each represent a hydrogen atom or a lower alkyl; $R^{13}$ represents a hydrogen atom, a lower alkyl group or a group of the formula:

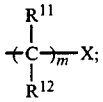

$R^{16}$ represents a lower alkyl group; $R^{19}$ represents $-NR^{20}R^{21}$, $-OR^{22}$ or $-SR^{22}$, $R^{20}$ and $R^{21}$ each represent a hydrogen atom or a lower alkyl group; $R^{22}$ represents a group of atoms necessary for formation of a ring by linking to $R^{18}$; $R^{20}$ or $R^{21}$ may be linked to $R^{18}$ to form a ring; M′ represents a hydrogen atom or a cation; said compounds of the formula (I)-(V) including enol derivatives and salts thereof.

9. A color image forming method according to claim 1, wherein said silver halide emulsion is core-shelled.

10. A color image forming method according to claim 8, wherein said compound is present in said bleach-fixing solution.

11. A color image forming method according to claim 10, wherein said compound is

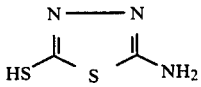

12. A color image forming method according to claim 1, wherein the total thickness of said photographic constituent layer is from 8 μm to 25 μm.

13. A color image forming method according to claim 3, wherein said organic acid ferric complex is iron (III) ammonium ethylenediamine tetraacetate.

* * * * *